US006004716A

United States Patent [19]

Kato et al.

[11] Patent Number: 6,004,716

[45] Date of Patent: Dec. 21, 1999

[54] METHOD OF FORMING AN ELECTROPHOTOGRAPHIC TRANSFER IMAGE

[75] Inventors: Eiichi Kato; Sadao Osawa, both of Shizuoka, Japan

[73] Assignee: Fuji Photo Film Co., Ltd., Kanagawa, Japan

[21] Appl. No.: 08/256,185

[22] PCT Filed: Dec. 25, 1992

[86] PCT No.: PCT/JP92/01715

§ 371 Date: Jun. 27, 1994

§ 102(e) Date: Jun. 27, 1994

[87] PCT Pub. No.: WO93/13462

PCT Pub. Date: Jul. 8, 1993

[30] Foreign Application Priority Data

Dec. 27, 1991 [JP] Japan ..... 3-358228
Dec. 27, 1991 [JP] Japan ..... 3-358232

[51] Int. Cl.[6] ..... G03G 13/14

[52] U.S. Cl. ..... 430/126; 430/132; 430/66; 430/47; 399/159; 399/298; 204/507; 204/509

[58] Field of Search ..... 430/126, 132, 430/66, 47, 46; 355/231, 277, 278; 204/507, 589; 399/159, 298

[56] References Cited

U.S. PATENT DOCUMENTS

| | | | |
|---|---|---|---|
| 4,686,163 | 8/1987 | Ng et al. | 430/126 |
| 4,851,313 | 7/1989 | Osawa et al. | 430/132 |
| 5,202,208 | 4/1993 | Kato | 430/96 |
| 5,342,720 | 8/1994 | Zwaldo et al. | 430/132 |
| 5,582,943 | 12/1996 | Kato et al. | 430/66 |

FOREIGN PATENT DOCUMENTS

| | | | |
|---|---|---|---|
| B48-33183 | 12/1973 | Japan . | |
| A60-179751 | 9/1985 | Japan . | |
| B61-19032 | 5/1986 | Japan . | |
| A2-176777 | 9/1990 | Japan . | |
| 4-258961 | 9/1992 | Japan | 430/132 |

*Primary Examiner*—Christopher D. Rodee
*Attorney, Agent, or Firm*—Sughrue, Mion, Zinn, Macpeak & Seas, PLLC

[57] ABSTRACT

A method of forming an electrophotographic transfer image is disclosed which provides color images free from color shear, by which toner images are completely transferred onto a receiving material without being accompanied by degradation of image quality upon the transfer, and in which a light-sensitive element can be repeatedly used without throwing the light-sensitive element away after using it only once.

A method and apparatus for forming an electrophotographic transfer image comprising forming a transfer layer containing a thermoplastic resin on the surface of an electrophotographic light-sensitive element which surface has releasability in the apparatus for forming an electrophotographic transfer image, forming a toner image by an electrophotographic process on the transfer layer, and heat-transferring the toner image together with the transfer layer onto a receiving material.

5 Claims, 3 Drawing Sheets

METHOD OF FORMING AN ELECTROPHOTOGRAPHIC TRANSFER IMAGE

TECHNICAL FIELD

The present invention relates to a method of forming an electrophotographic transfer image, and more particularly to a method of forming an electrophotographic transfer image which provides color images free from color shear and by which toner images are completely transferred onto a receiving material without being accompanied by degradation of image quality upon the transfer.

TECHNICAL BACKGROUND

Methods of forming color printings, color duplicates or color proofs (proofs for printing) which comprises conducting development with electrophotographic developing agents to form a plurality of overlapping color toner images directly on the surface of electrophotographic light-sensitive element and transferring at once the resulting color images onto a receiving material such as printing paper are known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to printing paper.

In order to solve this problem, a transfer technique in which a non-aqueous solvent is supplied between a light-sensitive element and a receiving material and then transfer is electrostatically performed is described in JP-A-2-272469 (the term "JP-A" as used herein means an "unexamined published Japanese patent application").

Also, a method in which a transparent film is first laminated on the surface of a light-sensitive element, wet type toner images are formed by an electrophotographic process on the film, and then the film bearing the toner images is separated from the light-sensitive element and stuck on paper, thereby forming transferred images, is described in JP-A-2-115865 and JP-A-2-115866. According to the method, the film to be laminated has suitably a thickness of 9 $\mu$m. However, the production and handling of a film having such thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form overlapping color separation images on a dielectric support releasably provided on the light-sensitive element and the dielectric support bearing the images is transferred to a receiving material, is described. Since the imagewise exposure is performed from the side of substrate for the light-sensitive element according to this method, the substrate is required to be transparent. This is disadvantageous in view of a cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper, is described in JP-A-1-112264, JP-A-1-281464 and JP-A-3-11347.

PROBLEMS TO BE SOLVED BY THE INVENTION

However, in order to employ the light-sensitive element repeatedly in the techniques hitherto known, a special operation is required at the time of transfer or difficulties in the formation of transfer layer are encountered. On the other hand, the method using a light-sensitive element having a transfer layer (or a releasable layer) previously formed thereon is disadvantageous in point of cost since the light-sensitive element used is inevitably thrown.

The present invention is to solve the above-described various problems associated with conventional methods of forming electrophotographic transfer images.

An object of the present invention is to provide a method of forming an electrophotographic transfer image which provides simply and stably color images of high accuracy and high quality without color shear and in which the formation and release of transfer layer is easily performed and a transfer layer is easily formed on a light-sensitive element on demand in an apparatus for transfer and the light-sensitive element is repeatedly usable, thereby reducing a running cost.

Another object of the present invention is to provide a method of forming an electrophotographic transfer image which can provide a proof on printing paper without using specific transfer paper by an apparatus for transfer having a simple structure and which is hardly affected by environmental conditions, in particular, humidity and has good reproducibility in repeated use.

A further object of the present invention is to provide a method of forming an electrophotographic transfer image in which releasability of the surface of electrophotographic light-sensitive element is further improved and preserved and a clear interface between a photoconductive layer and a transfer layer is formed and maintained.

A still further object of the present invention is to provide an apparatus which is suitable for use in the method of forming an electrophotographic transfer image.

Other objects of the present invention will become apparent from the following description.

DISCLOSURE OF THE INVENTION

It has been found that the above described objects of the present invention are accomplished by a method of forming an electrophotographic transfer image comprising (a) a step of forming a peelable transfer layer which is mainly composed of a thermoplastic resin on the surface of electrophotographic light-sensitive element which surface has releasability, (b) a step of forming a toner image by an electrophotographic process on the transfer layer, and (c) a step of heat-transferring the toner image together with the transfer layer onto a receiving material.

It has also been found that they are accomplished by an apparatus for forming an electrophotographic transfer image comprising (a) an electrophotographic light-sensitive element a surface of which has releasability, (b) a means for forming a peelable transfer layer which is mainly composed of a thermoplastic resin on the surface of electrophotographic light-sensitive element, (c) a means for forming a toner image by an electrophotographic process on the transfer layer, and (d) a means for heat-transferring the toner image together with the transfer layer onto a receiving material.

Specifically the method of forming an electrophotographic transfer image according to the present invention is characterized by employing an electrophotographic light-sensitive element a surface of which has releasability, forming a transfer layer on the surface of electrophotographic light-sensitive element, forming a toner image by a conventional electrophotographic process on the transfer layer and transferring the toner image onto another substrate (i.e., receiving material) by peeling the transfer layer together with the toner image.

According to the present invention, since a transfer layer is formed on the surface of light-sensitive element in an apparatus for transfer contrary to employing a light-sensitive element having a transfer layer previously formed, the light-sensitive element can be repeatedly used after the transfer layer is released therefrom without throwing the light-sensitive element away after using it only once. Also, the method of the present invention has a remarkable feature in that the formation and release of transfer layer can be performed in sequence with the electrophotographic process in an electrophotographic duplicating machine or plate-making machine.

Now, the transfer layer which can be used in the present invention will be described in greater detail below.

The transfer layer which is mainly composed of a thermoplastic resin according to the present invention is radiation-transmittive. Specifically, it is a layer capable of transmitting a radiation having a wavelength which constitutes at least one part of the spectrally sensitive region of electrophotographic light-sensitive element. The layer may be colored. In a case wherein duplicated images transferred on a receiving material are color images, particularly full-color images, a colorless and transparent transfer layer is usually employed.

As the thermoplastic resin which mainly constitutes the peelable transfer layer, any thermoplastic resin having a glass transition point (Tg) of from 20° C. to 90° C. or a softening point of from 40° C. to 150° C. can be employed. The thermoplastic resin used preferably has a weight average molecular weight of from $1\times10^3$ to $1\times10^6$, and more preferably from $3\times10^3$ to $5\times10^5$.

Suitable examples of the thermoplastic resin which meets the above described physical properties include vinyl chloride resins, polyolefin resins, olefin-styrene copolymer resins, vinyl alkanoate resins, polyester resins, polyether resins, acrylic resins, cellulose resins, and fatty acid-modified cellulose resins. Specific examples of usable resins are described, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook* (*Oyo-hen*), Ch. 1, Baifukan (1986), and Yuji Harasaki, *Saishin Binder Gijutsu Binran*, Ch. 2, Sogo Gijutsu Center (1985).

The thermoplastic resin is preferably used in a range of not less than 70% by weight, more preferably not less than 90% by weight, based on the total amount of composition for the transfer layer. These thermoplastic resins may be used either individually or in combination of two or more thereof.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer suitably has a thickness of from 0.1 to 20 $\mu$m, and preferably from 0.5 to 10 $\mu$m. If the transfer layer is too thin, it is liable to result in insufficient transfer, and if the layer is too thick, troubles on the electrophotographic process tend to occur, failing to obtain a sufficient image density or resulting in degradation of image quality.

In order to form the transfer layer on the surface of light-sensitive element in the present invention, a hot-melt coating method, an electrodeposition coating method or a transfer method is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive drum. Suitable examples of coating machines include a direct roll coater, an offset gravure roll coater, a rod coater, an extrusion coater, a slot orifice coater, and a curtain coater.

A melting temperature of the thermoplastic resin at coating is usually in a range of from 50 to 180° C., while the optimum temperature is determined depending on the composition of the thermoplastic resin to be used. It is preferred that the resin is first molten using a closed pre-heating device having an automatic temperature controlling means and then heated in a short time to the desired temperature in a position to be coated on the light-sensitive element. To do so can prevent from degradation of the thermoplastic resin upon thermal oxidation and unevenness in coating.

A coating speed may be varied depending on flowability of the thermoplastic resin at the time of being molten by heating, a kind of coater, and a coating amount, etc., but is suitably in a range of from 1 to 100 mm/sec, preferably from 5 to 40 mm/sec.

Now, the electrodeposition coating method will be described below. According to this method, the thermoplastic resin is electrostatically adhered or electrodeposited (hereinafter simply referred to as electrodeposition sometimes) on the surface of light-sensitive element in the form of resin grains and then transformed into a uniform thin film, for example, by heating, thereby forming the transfer layer.

Therefore, the thermoplastic resin grains must have either a positive charge or a negative charge. The electroscopicity of the resin grains is appropriately determined depending on a charging property of the electrophotographic light-sensitive element to be used in combination.

An average grain diameter of the resin grains having the physical property described above is generally in a range of from 0.01 to 15 μm, preferably from 0.05 to 5 μm and more preferably from 0.1 to 1 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering, and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction, or a suspension polymerization reaction each conducted in an aqueous system and using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), Soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.,* 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kagaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975).

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is usually a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The method in which grains mainly comprising the thermoplastic resin dispersed in an electrical insulating solvent having an electric resistance of not less than $10^8$ Ω·cm and a dielectric constant of not more than 3.5 are supplied is preferred in view of easy preparation of the transfer layer having a uniform and small thickness.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xyrene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606, 989, JP-A-60-179751, JP-A-60-185963 and JP-A-2-13965.

The dispersion of resin grains in a non-aqueous system (latex) which can be employed for electrodeposition usually comprises from 0.1 to 20 g of grains containing mainly the thermoplastic resin, from 0.01 to 50 g of a dispersion stabilizing resin and if desired, from 0.0001 to 10 g of a charge control agent in one liter of an electrically insulating dispersive medium.

The thermoplastic resin grains which are prepared, provided with an electrostatic charge and dispersed in an electrically insulting liquid, behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains mainly comprising the thermoplastic resin are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The amount of thermoplastic resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the thermoplastic resin grains in the form of a film, thereby the transfer layer being formed.

Now, the formation of transfer layer by the transfer method will be described below. According to this method, the transfer layer provided on a releasable support typically represented by release paper (hereinafter simply referred to as release paper) is transferred onto the surface of electrophotographic light-sensitive element.

The release paper having the transfer layer thereon is simply supplied to a transfer device in the form of a roll or sheet.

The release paper which can be employed in the present invention include those conventionally known as described, for example, in *Nenchaku* (*Nensecchaku*) *no Shin Gijutsu to Sono Yoto.Kakushu Ovoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Ohji Seishi K.K.), King Rease (manufactured by Shikoku Seishi K.K.), San-release (manufactured by Sanyo Kokusaku Pulp K.K.) and NK High Release (manufactured by Nippon Kako Seishi K.K.).

In order to form the transfer layer on release paper, a composition for the transfer layer mainly composed of the thermoplastic resin is applied to releasing paper in a conventional manner, for example, by bar coating, spin coating or spray coating to form a film.

For a purpose of heat transfer of the transfer layer on release paper to the electrophotographic light-sensitive element, conventional heat transfer methods are utilized. Specifically, release paper having the transfer layer thereon is pressed on the electrophotographic light-sensitive element to heat transfer the transfer layer. For instance, a device shown in FIG. 4 is employed for such a purpose. In FIG. 4, release paper 10 having thereon the transfer layer 12 comprising the thermoplastic resin is heat-pressed on the light-sensitive element by a heating roller 117*b*, thereby the transfer layer 12 being transferred on the surface of light-sensitive element 11. The release paper 10 is cooled by a cooling roller 117*c* and recovered. The light-sensitive element is heated by a pre-heating means 17*a* to improve transferability of the transfer layer 12 upon heat-press, if desired.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25 to 100° C. and more preferably from 40 to 80° C. A speed of the transportation is from 0.5 to 100 mm/sec and more preferably from 3 to 50 mm/sec. The speed of transportation may differ from that of the electrophotographic step or that of the heat transfer step of the transfer layer to the receiving material.

Now, the electrophotographic light-sensitive element on the surface of which the transfer layer is formed will be described in detail below.

Any conventionally known electrophotographic light-sensitive element can be employed as long as the surface of the light-sensitive element has releasability so as to easily release the transfer layer provided thereon.

More specifically, an electrophotographic light-sensitive element wherein an adhesive strength of the surface thereof measured according to JIS Z 0237-1980 "Testing methods of pressure sensitive adhesive tapes and sheets" is not more than 200 gram·force is exemplified.

One example of such an electrophotographic light-sensitive element is one using amorphous silicon as a photoconductive substance. Another example thereof is an electrophotographic light-sensitive element containing a polymer having a polymer component containing at least one of a silicon atom and a fluorine atom in the region near to the surface thereof. The term "region near to the surface of electrophotographic light-sensitive element" used herein means the uppermost layer of the light-sensitive element and includes an overcoat layer provided on a photoconductive layer and the uppermost photoconductive layer. Specifically, an overcoat layer is provided on the light-sensitive element having a photoconductive layer as the uppermost layer which contains the above-described polymer to impart the releasability, or the above-described polymer is incorporated into the uppermost layer of a photoconductive layer (including a single photoconductive layer and a laminated photoconductive layer) to modify the surface thereof so as to exhibit the releasability. By using such a light-sensitive element, the transfer layer can be easily and completely transferred to a receiving material since the surface of the light-sensitive element has the good releasability.

In order to impart the releasability to the overcoat layer or the uppermost photoconductive layer, a polymer containing a silicon atom and/or a fluorine atom is used as a binder resin of the layer. It is also preferred to use a small amount of a block copolymer containing a polymer segment comprising a silicon atom and/or fluorine atom-containing polymer component described in greater detail below (hereinafter referred to as a surface-localized type copolymer) in combination with other binder resins. Further, such a resin containing a silicon atom and/or a fluorine atom is employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-62-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component in a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in U.S. patent application Ser. No. 07/952,941 filed Sep. 28, 1992.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in the above-identified U.S. patent application. Alternatively, a photo- and/or heat-curable resin may be used in combination with the fluorine atom and/or silicon atom-containing resin according to the present invention.

Where the polymer containing a fluorine atom and/or silicon atom-containing polymer component used in the present invention is a random copolymer, the content of the fluorine atom and/or silicon atom-containing polymer component is preferably not less than 60% by weight, and more preferably not less than 80% by weight in the total polymer components.

In a preferred embodiment, the above-described polymer is a block copolymer comprising at least one polymer segment (A) containing not less than 50% by weight of a fluorine atom and/or silicon atom-containing polymer component and at least one polymer segment (B) containing 0 to 20% by weight of a fluorine atom and/or silicon atom-containing polymer component, the polymer segments (A) and (B) being bonded in the form of blocks. More preferably, the polymer segment (B) of the block copolymer contains at least one polymer component containing at least one photo- and/or heat-curable functional group.

It is preferred that the polymer segment (B) does not contain any fluorine atom and/or silicon atom-containing polymer component.

As compared with a random copolymer, the block copolymer comprising the polymer segments (A) and (B) (surface-localized type copolymer) is more effective not only for improving the surface releasability but also for maintaining such a releasability.

More specifically, where a film is formed in the presence of a small amount of the resin of block copolymer containing a fluorine atom and/or a silicon atom, the resins easily migrate to the surface portion of the film and are concentrated there by the end of a drying step of the film to thereby modify the film surface so as to exhibit the releasability.

Where the resin is the block copolymer in which the fluorine atom and/or silicon atom-containing polymer segment exists in a block, the other polymer segment containing no, or if any a small proportion of, fluorine atom and/or silicon atom-containing polymer component undertakes sufficient interaction with the film-forming binder resin since it has good compatibility therewith. Thus, during the formation of the transfer layer on the light-sensitive element, further migration of the resin into the transfer layer is inhibited or prevented by an anchor effect to form and maintain the definite interface between the transfer layer and the photoconductive layer.

Further, where the segment (B) of the block copolymer contains a photo- and/or heat-curable group, crosslinking between the polymer molecules takes place during the film formation to thereby ensure retention of the releasability at the interface between the light-sensitive element and the transfer layer.

The above-described polymer may be used in the form of resin grains as described above. Preferred resin grains are resin grains dispersible in a non-aqueous solvent. Such resin grains include a block copolymer comprising a non-aqueous solvent-insoluble polymer segment which contains a fluorine atom and/or silicon atom-containing polymer component and a non-aqueous solvent-soluble polymer segment which contains no, or if any not more than 20% of, fluorine atom and/or silicon atom-containing polymer component.

Where the resin grains according to the present invention are used in combination with a binder resin, the insolubilized polymer segment undertakes migration of the grains to the-surface portion and concentration there while the soluble polymer segment exerts an interaction with the binder resin (an anchor effect) similarly to the above-described resin. When the resin grains contain a photo- and/or heat-curable group, further migration of the grains to the transfer layer can be avoided.

Now, the polymer component containing a fluorine atom and/or silicon atom-containing substituent according to the present invention will be described in detail below. The fluorine atom and/or silicon atom-containing substituent may be incorporated into the polymer main chain of the polymer or may be contained as a substituent of the polymer side chain.

The fluorine atom-containing substituents include monovalent or divalent organic residues, for example, $—C_hF_{2h+1}$ (wherein h represents an integer of from 1 to 18), $—(CF_2)_jCF_2H$ (wherein j represents an integer of from 1 to 17), $—CFH_2$,

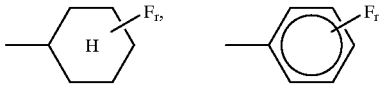

(wherein r represents an integer of from 1 to 5), $—CF_2—$, —CFH—,

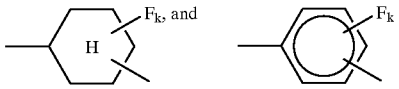

(wherein k represents an integer of from 1 to 4).

The silicon atom-containing substituents include monovalent or divalent organic residues, for example,

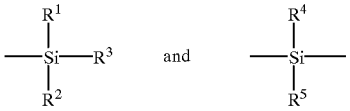

wherein $R^1$, $R^2$, $R^3$, $R^4$, and $R^5$, which may be the same or different, each represents a hydrocarbon group which may be substituted or $—OR^6$ wherein $R^6$ represents a hydrocarbon group which may be substituted.

The hydrocarbon group represented by $R^1$, $R^2$, $R^3$, $R^4$ or $R^5$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl). $R^6$ in $—OR^6$ has the same meaning as the above-described hydrocarbon group for $R^1$.

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g.,

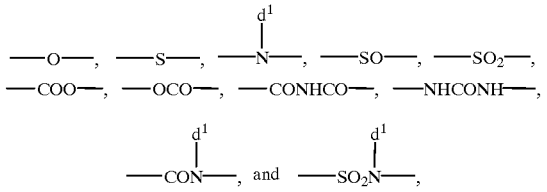

wherein $d^1$ has the same meaning as $R^1$ above.

Examples of the divalent aliphatic groups are shown below.

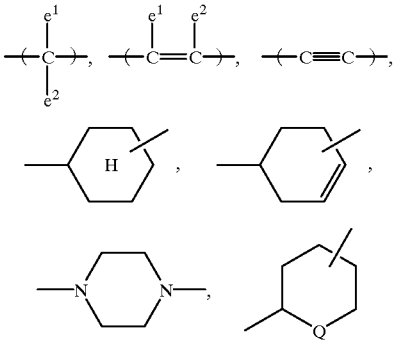

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

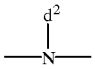

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing substituent as described above are set forth below, but the present invention should not be construed as being limited thereto. In formulae (a-1) to (a-32) below, $R_f$ represents any one of the following groups of from (1) to (11); and b represents a hydrogen atom or a methyl group.

(1) $—C_nF_{2n+1}$ (2) $—CH_2C_nF_{2n+1}$ (3) $—CH_2CH_2C_nF_{2n+1}$ (4) $—CH_2(CH_2)_mCFHCF_3$ (5) $—CH_2CH_2(CH_2)_mCFHCF_3$ (6) $—CH_2CH_2(CH_2)_mCFHCF_2H$ (7) $—CH_2(CF_2)_mCFHCF_2H$ (8)

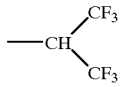

(9)

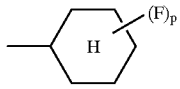

(10)

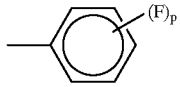

(11)

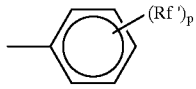

wherein $R_f'$ represents any one of the above-described groups of from (1) to (8); n represents an integer of from 1 to 18; m represents an integer of from 1 to 18; and p represents an integer of from 1 to 5.

(a-1)

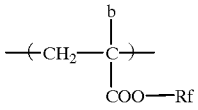

(a-2)

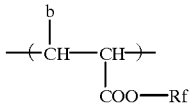

(a-3)

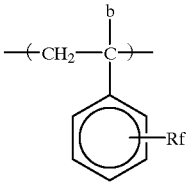

-continued
(a-4)
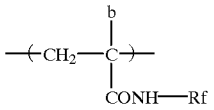
(a-5)
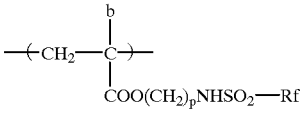
p: an integer of from 1 to 12
(a-6)
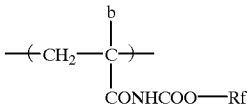
(a-7)
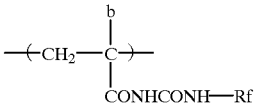
(a-8)
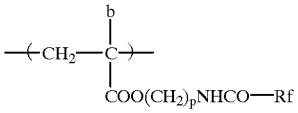
(a-9)
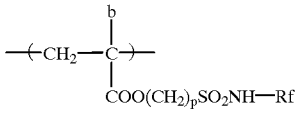
(a-10)
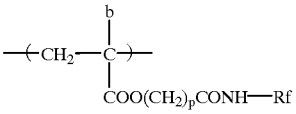
(a-11)
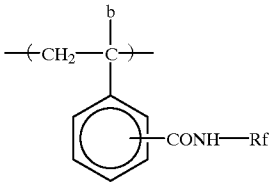
(a-12)
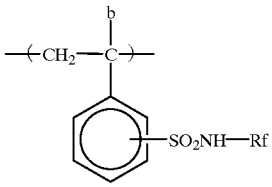
-continued
(a-13)
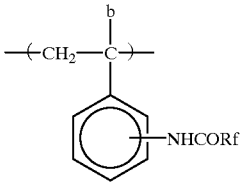
(a-14)
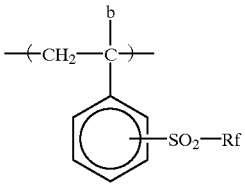
(a-15)
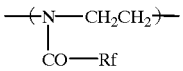
(a-16)
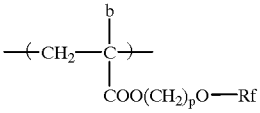
(a-17)
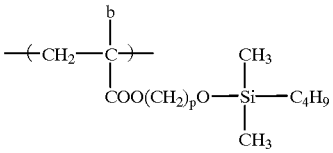
(a-18)
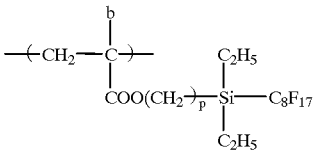
(a-19)
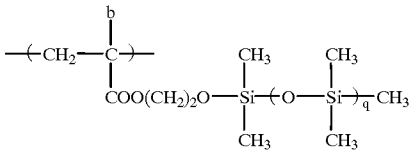
q: an integer of from 1 to 20
(a-20)
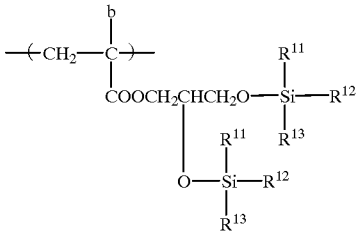
$R^{11}$, $R^{12}$, $R^{13}$: an alkyl group having from 1 to 12 carbon atoms -continued (a-21)

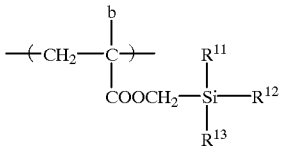

(a-22)

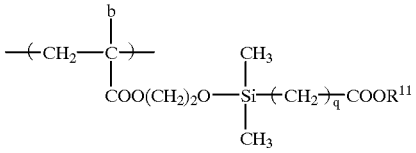

(a-23)

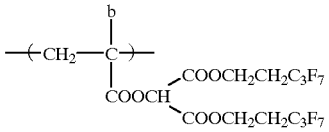

(a-24)

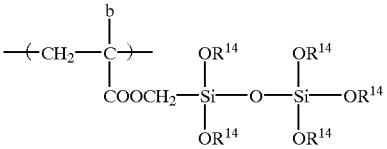

$R^{14}$: 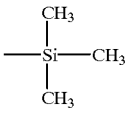

(a-25)

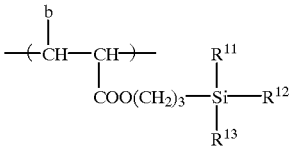

(a-26)

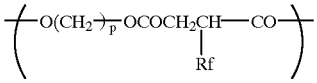

(a-27)

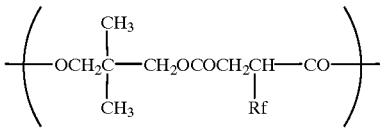

(a-28)

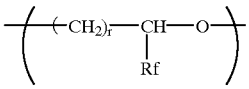

r: an integer of from 3 to 6

(a-29)

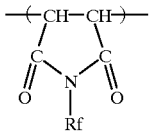

-continued (a-30)

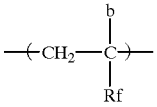

(a-31)

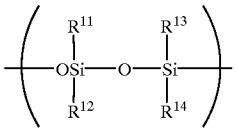

(a-32)

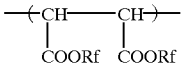

Of the resins (hereinafter sometimes referred to as resin (P)) and resin grains (hereinafter sometimes referred to as resin grain (L)) each containing silicon atom and/or fluorine atom used in the present invention, the so-called surface-localized type copolymers will be described in detail below.

The content of the silicon atom and/or fluorine atom-containing polymer component in the segment (A) is at least 50% by weight, preferably not less than 70% by weight, and more preferably not less than 80% by weight. The content of the fluorine atom and/or silicon atom-containing polymer component in the segment (B) bonded to the segment (A) is not more than 20% by weight, and preferably 0% by weight.

A weight ratio of segment (A) to segment (B) ranges usually from 1/99 to 95/5, and preferably from 5/95 to 90/10. If the weight ratio is out of this range, the migration effect and anchor effect of the resin (P) or resin grain (L) at the surface region of light-sensitive element are decreased and, as a result, the releasability in order to peel the transfer layer is reduced.

The resin (P) preferably has a weight average molecular weight of from $5\times10^3$ to $1\times10^6$, and more preferably from $1\times10^4$ to $5\times10^5$. The segment (A) in the resin (P) preferably has a weight average molecular weight of at least $1\times10^3$.

The resin grain (L) preferably has an average grain diameter of from 0.001 to 1 $\mu$m, and more preferably from 0.05 to 0.5 $\mu$m.

A preferred embodiment of the surface-localized type copolymer in the resin (P) according to the present invention will be described below. Any type of the block copolymer can be used as far as the fluorine atom and/or silicon atom-containing polymer component is contained in block. The term "to be contained in block" means that the polymer has the polymer segment (A) containing not less than 50% by weight of the fluorine atom and/or silicon atom-containing polymer component. The forms of blocks include an A-B type block, an A-B-A type block, a B-A-B type block, a grafted type block, and a starlike type block as schematically illustrated below.

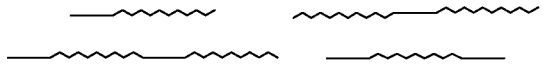

A–B Type A–B–A (B–A–B) Type

-continued

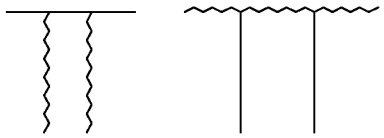

Graft Type (The number of the grafts is arbitrary)

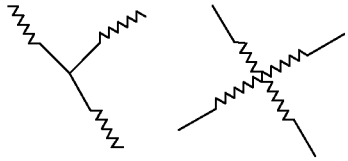

Starlike Type (The number of the branches is arbitrary)

: Segment A (containing fluorine atom and/or silicon atom)

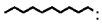 : Segment B (containing no or little fluorine atom and/or silicon atom)

These various types of block copolymers (P) can be synthesized in accordance with conventionally known polymerizing methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, P. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higasimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechanochemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers (P) according to the present invention is not limited to these methods.

A preferred embodiment of the resin grains (L) according to the present invention will be described below. As described above, the resin grains (L) preferably comprises the fluorine atom and/or silicon atom-containing polymer segment (A) insoluble in a non-aqueous solvent and the polymer segment (B) which is soluble in a non-aqueous solvent and contains substantially no fluorine atom and/or silicon atom, and have an average grain diameter of not more than 1 $\mu$m. The polymer segment (A) constituting the insoluble portion of the resin grain may have a crosslinked structure.

Preferred methods for synthesizing the resin grains (L) described above include the non-aqueous dispersion polymerization method hereinbefore described with respect to the non-aqueous thermoplastic resin grains. Specific examples of the method described above are also applied to the resin grains (L).

The non-aqueous solvents which can be used in the preparation of the non-aqueous solvent-dispersed resin grains include any organic solvents having a boiling point of not more than 200° C., either individually or in combination of two or more thereof. Specific examples of such organic solvents include those described with respect to the non-aqueous dispersion polymerization method above.

Dispersion polymerization in such a non-aqueous solvent system easily results in the production of mono-dispersed resin grains having an average grain diameter of not greater than 1 $\mu$m with a very narrow size distribution.

More specifically, a monomer corresponding to the polymer component constituting the segment (A) (hereinafter referred to as a monomer (a)) and a monomer corresponding to the polymer component constituting the segment (B) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (B) (hereinafter referred to as a polymer (PB)) are polymerized in the same manner as described above.

The inside of the polymer grain (L) according to the present invention may have a crosslinked structure. The formation of crosslinked structure can be conducted by any of conventionally known techniques. For example, (i) a method wherein a polymer containing the polymer segment (A) is crosslinked in the presence of a crosslinking agent or a curing agent; (ii) a method wherein at least the monomer (a) corresponding to the polymer segment (A) is polymerized in the presence of a polyfunctional monomer or oligomer containing at least two polymerizable functional groups to form a network structure over molecules; or (iii) a method wherein the polymer segment (A) and a polymer containing a reactive group-containing polymer component are subjected to a polymerization reaction or a polymer reaction to cause crosslinking may be employed.

The crosslinking agents to be used in the method (i) include those commonly employed as described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kiso-hen*), Baifukan (1986).

Specific examples of suitable crosslinking agents include organosilane compounds known as silane coupling agents (e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (ii) above include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers, or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (iii), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 $\mu$m or smaller, the method (ii) using a polyfunctional monomer is preferred for the formation of network structure. Specifically, a monomer (a), a monomer (b) and/or a polymer (PB) and, in addition, a polyfunctional monomer (d) are subjected to polymerization granulation reaction to obtain resin grains. Where the above-described polymer (PB) comprising the segment (B) is used, it is preferable to use a polymer (PB') which has a polymerizable double bond group copolymerizable with the monomer (a) in the side chain or at one terminal of the main chain of the polymer (PB).

The polymerizable double bond group is not particularly limited as far as it is copolymerizable with the monomer (a). Specific examples thereof include

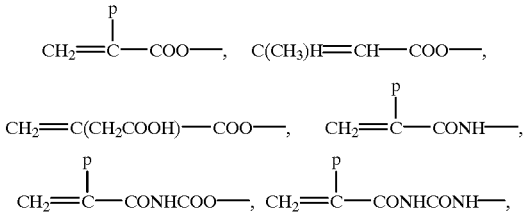

$C(CH_3)H{=}CH{-}CONH{-}$, $CH_2{=}CHCO{-}$, $CH_2{=}CH(CH_2)_n{-}OCO{-}$ (wherein n represents 0 or an integer of from 1 to 3), $CH_2{=}CHO{-}$, and $CH_2{=}CH{-}C_6H_4{-}$, wherein p represents —H or —$CH_3$.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group in the block copolymer (P) ranges from 1 to 95 parts by weight, and preferably from 10 to 70 parts by weight, based on 100 parts by weight of the polymer segment (B) therein. Also, the content is preferably from 5 to 40 parts by weight based on 100 parts by weight of the total polymer component of the block copolymer (P).

The photo- and/or heat-curable group-containing block copolymer (P) is preferably used in an amount of not more than 40% by weight based on the total binder resins in the layer to which the resin (P) is added. If the proportion of the resin (P) is more than 40% by weight, the electrophotographic characteristics of the light-sensitive element tend to be deteriorated.

The fluorine atom and/or silicon atom-containing resin may also be used in combination with the photo- and/or heat-curable resin (D) in the present invention. The photo- and/or heat-curable group in the resin (D) is not particularly limited and includes those described above with respect to the block copolymer.

Any of conventionally known curable resins may be used as the photo- and/or heat-curable resin (D). For example, resins containing the curable group as described with respect to the block copolymer (P) may be used.

These conventionally known binder resins for an electrophotographic light-sensitive layer are described, e.g., in Takaharu Shibata and Jiro Ishiwatari, *Kobunshi*, Vol. 17, p. 278 (1968), Harumi Miyamoto and Hidehiko Takei, Imaging, Vol. 1973, No. 8, Koichi Nakamura (ed.), *Kiroku Zairyoyo Binder no Jissai Gijutsu*, Ch. 10, C. M. C. (1985), Denshishashin Gakkai (ed.), *Denshishashinyo Yukikankotai no Genjo Symposium* (preprint) (1985), Hiroshi Kokado (ed.), *Saikin no Kododenzairyo to Kankotai no Kaihatsu.Jitsuyoka*, Nippon Kagaku Joho (1986), Denshishashin Gakkai (ed.), *Denshishashin Gijutsu no Kiso To Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshishashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei.Sekkei to Shinyoto Kaihatsu*, Chubu Kei-ei Kaihatsu Center Shuppanbu (1985), and Eizo Omori, *Kinosei Acryl-Kei Jushi*, Techno System (1985).

As described above, while the overcoat layer or the photoconductive layer contains the silicon atom and/or fluorine atom-containing resin and, if desired, other binder resins, it is preferred that the layer further contains a small amount of photo- and/or heat-curable resin (D) and/or a crosslinking agent for further improving film curability.

The amount of photo- and/or heat-curable resin (D) and/or crosslinking agent to be added is from 0.01 to 20% by weight, and preferably from 0.1 to 15% by weight, based on the total amount of the whole binder resins in the layer to which the resin (D) is added. If the amount is less than 0.01% by weight, the effect of improving film curability decreases. If it exceeds 20% by weight, the electrophotographic characteristics may be adversely affected.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kisohen*), Baifukan (1986).

Specific examples of suitable crosslinking agents include organosilane compounds (such as silane coupling agents, e.g., vinyltrimethoxysilane, vinyltributoxysilane, γ-glycidoxypropyltrimethoxysilane, γ-mercaptopropyltriethoxysilane, and γ-aminopropylethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, a polyoxyethylene glycol, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltrisstearoyl titanate), aluminum coupling compounds (e.g., aluminum butylate, aluminum acetylacetate, aluminum oxide octate, and aluminum trisacetylacetate), polyepoxy-containing compounds and epoxy resins (e.g., the compounds as described in Hiroshi Kakiuchi (ed.), *Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)). In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the photoconductive layer (a layer which will be in contact with the transfer layer) is preferably cured after film formation. It is preferred that the binder resin, the block copolymer (P), the curable resin (D), and the crosslinking agent to be used in the photoconductive layer are so selected and combined that their functional groups easily undergo chemical bonding to each other.

Combinations of functional groups which easily undergo a polymer reaction are well known. Specific examples of such combinations are shown in Table 1 below, wherein a functional group selected from Group A can be combined with a functional group selected from Group B. However, the present invention should not be construed as being limited thereto.

TABLE 1

| Group A | Group B |
|---|---|
| —COOH, —$PO_3H_2$, —OH, —SH, —$NH_2$, —NHR, —$SO_2H$ | 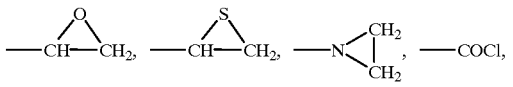 —$SO_2Cl$, a cyclic acid anhydride group, —N=C=O, —N=C=S, 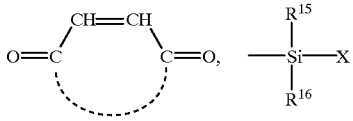 (X: Cl, Br), |

TABLE 1-continued

| Group A | Group B |
|---|---|
| | 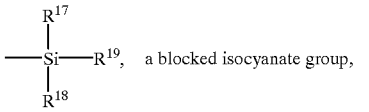 a blocked isocyanate group, |
| | 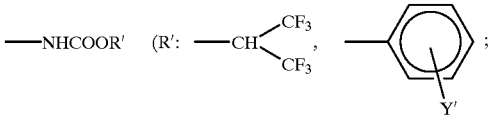 ; Y': —$CH_3$, —Cl, —$OCH_3$), |
| | 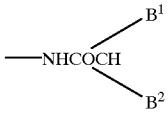 ($B^1$, $B^2$: an electron attracting group), |
| | 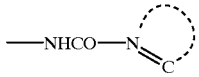 (e.g., an imidazole ring) |

In Table 1, $R^{15}$ and $R^{16}$ each represents an alkyl group; $R^{17}$, $R^{18}$, and $R^{19}$ each represents an alkyl group or an alkoxy group, provided that at least one of them is an alkoxy group; R represents a hydrocarbon group; $B^1$ and $B^2$ each represent an electron attracting group, e.g., —CN, —$CF_3$, —$COR^{20}$, —$COOR^{20}$, —$SO_2OR^{20}$ ($R^{20}$ represents a hydrocarbon group, e.g., $C_nH_{2n+1}$ (n: an integer of from 1 to 4), —$CH_2C_6H_5$, or —$C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., di-ethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made more moderate by using the above-described reaction accelerator in combination.

Curing of the resin containing a photocurable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

The photoconductive substances for the electrophotographic light-sensitive element which can be used in the present invention are not particularly limited, and any known photoconductive substances may be employed. Suitable photoconductive substances are described, e.g., in Denshishashin Gakkai (ed.), *Denshishashin Gijutsu no Kiso to Oyo*, Corona Sha (1988) and Hiroshi Kokado (ed.), *Saikin no Kododen Zairyo to Kankotai no Kaihatsu·Jitsuyoka*, Nippon Kagaku Joho (1985).

Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound. organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (1) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethyl-carbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

A mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

The binder resins which can be used in the light-sensitive element according to the present invention include those for conventionally known electrophotographic light-sensitive elements. A preferred weight average molecular weight of the binder resin is from $5\times10^3$ to $1\times10^6$, and particularly from $2\times10^4$ to $5\times10^5$. A preferred glass transition point of the binder resin is from −40° to 200° C., and particularly from −10° to 140° C.

Conventional binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kioku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu·Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, 2,3-dichloro-5,6-dicyanobenzoquinone, dinitrofluorenone, trinitrofluorenone, and tetracyanoethylene; and polyarylalkane compounds, hindered phenol compounds and p-phenylenediamine compounds as described in the literature references cited in Hiroshi Kokado, et al., *Saikin no Kododen Zairyo to Kankotai no Kaihatsu·Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

As described above, the electrophotographic light-sensitive element of the present invention is characterized in that its surface in contact with the transfer layer has good releasability. Whether the releasability is good or bad is determined upon an adhesive strength measured according to JIS Z 0237-1980 "Testing methods of pressure sensitive adhesive tapes and sheets". More specifically, the adhesive strength of the surface in contact with the transfer layer measured according to the above-described testing method is suitably not more than 200 gram·force (g·f), preferably not more than 150 g·f, and more preferably not more than 100 g·f. The testing is conducted using the electrophotographic light-sensitive element of the present invention as the test plate and an adhesive tape of 6 mm in width as the adhesive tape at a peeling rate of 120 mm/min. The value thus-obtained is calculated in terms of an adhesive tape of 10 mm in width to determine the adhesive strength.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu·Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo·Teichaku·Taiden·Tensha", Gakkai Shuppan Center.

Dry developers practically used include one-component magnetic toners, two-component toners, one-component non-magnetic toners, and capsule toners. Any of these dry developers may be employed in the present invention. Particularly, a combination of a scanning exposure system using a laser beam based on digital information and a development system using a liquid developer is an advantageous process since highly accurate images can be obtained.

The typical liquid developer is basically composed of an insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, -in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The heat-transfer of the toner image together with the transfer layer onto a receiving material can be performed using known methods and apparatus.

The receiving material used in the present invention is not particularly limited and any material conventionally known can be employed. Suitable examples of the receiving materials include those of reflective type, for example, natural paper such as high quality paper, coated paper or art paper, synthetic paper, a metal plate such as an aluminum, iron or SUS plate, and those of transmittive type, for example, a plastic film such as a polyester, polyolefin, polyvinyl chloride or polyacetate film.

Now, the method of forming an electrophotographic transfer image according to the present invention will be described in greater detail as well as an apparatus useful for carrying out the method with reference to the accompanying drawings, hereinbelow.

The method of forming an electrophotographic transfer image according to the present invention is classified into three embodiments depending on method for the formation of transfer layer, as described above.

FIG. 1 is a schematic view of an apparatus for forming an electrophotographic transfer image suitable for carrying out the method of the present invention, in which the transfer layer is formed by the hot-melt coating method.

Thermoplastic resin 12*a* is coated to form a transfer layer 12 on the surface of a light-sensitive element 11 provided on the peripheral surface of a drum by a hot-melt coater 13 and is caused to pass under a suction/exhaust unit 15 to be cooled to a predetermined temperature. After the hot-melt coater 13 is moved to the stand-by position indicated as 13*a*, a liquid developing unit set 14 is moved to the position where the hot-melt coater 13 was. The unit set 14 is provided with developing units containing yellow, magenta, cyan and black liquid developers respectively.

The light-sensitive element 11 bearing thereon the transfer layer 12 composed of the thermoplastic resin is then subjected to the electrophotographic process. Specifically, when it is uniformly charged to, for instance, a positive polarity by a corona charger 18 and then is exposed imagewise by an exposure device (e.g., a semiconductor laser) 19 on the basis of yellow image information, the potential is lowered in the exposed regions and thus, a contrast in potential is formed between the exposed regions and the unexposed regions. A yellow liquid developing unit 14*y* containing a liquid developer comprising yellow pigment particles having positive electrostatic charge dispersed in an electrical insulating dispersive medium among the liquid developing unit set 14 is brought near the surface of the light-sensitive material and is kept stationary with a gap of 1 mm therebetween.

The light-sensitive material is first pre-bathed by a pre-bathing means provided in the liquid developing unit and then, the yellow liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer is subsequently washed off by a rinsing means built in the liquid developing unit and the rinse solution adhering to the surface of light-sensitive material is removed by a squeezing means. Then the light-sensitive material is dried by passing under the suction/exhaust unit 15.

The above described electrophotographic process is repeated with respect to each image information of magenta, cyan and black. Meanwhile a heat transfer means 17 is kept away from the surface of the light-sensitive material.

After four color images are formed on the transfer layer, the transfer layer is pre-heated by a pre-heating means 17*a* and is pressed against a rubber roller 17*b* having therein a heater with a temperature control means with the receiving material 16 intervening therebetween. The transfer layer and the receiving material are then cooled by passing under a cooling roller 17*c*, thereby heat-transferring the toner image to the receiving material together with the transfer layer. Thus a cycle of steps is terminated.

The heat transfer means 17 for heat-transferring the transfer layer to the receiving material comprises the pre-heating means 17*a*, the heating roller 17*b* which is in the form of a metal roller having therein a heater and is covered with rubber, and the cooling roller 17*c*. As the pre-heating means 17*a*, a non-contact type heater such as an infrared line heater, a flash heater or the like is used, and the transfer layer is pre-heated in a range below a temperature of the surface of the light-sensitive material achieved with heating by the heating roller 17*b*. The surface temperature of light-sensitive material heated by the heating roller 17*b* is preferably in a range of from 50 to 150° C., and more preferably from 80 to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller 17*c* is maintained within a predetermined range.

The nip pressure of the rollers is preferably in a range of from 0.2 to 20 kgf/cm$^2$ and more preferably from 0.5 to 15 kgf/cm$^2$. Although not shown, the rollers may be pressed by springs provided on opposite ends of the roller shaft or by an air cylinder using compressed air.

A speed of the transportation is suitably in a range of from 0.1 to 100 mm/sec and preferably in a range of from 1 to 30 mm/sec. The speed of transportation may differ between the electrophotographic process and the heat transfer step.

By stopping the apparatus in the state where the transfer layer has been formed, the next operation can start with the electrophotographic process. Thus, the transfer layer acts to protect the light-sensitive element and prevent the properties of the light-sensitive element from deteriorating due to environmental influence.

It is needless to say that the above-described conditions should be optimized depending on the physical properties of the transfer layer, the light-sensitive element (i.e., the light-sensitive layer and the support) and the receiving material. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner thereon.

FIG. 2 is a schematic view of another apparatus for forming an electrophotographic transfer image suitable for carrying out the method of the present invention, in which the transfer layer is formed by the electrodeposition coating method.

A dispersion 12*b* of thermoplastic resin grains is supplied to an electrodeposition unit 14T provided in a movable liquid developing unit set 14. The electrodeposition unit 14T is first brought near the surface of the light-sensitive element 11 and is kept stationary with an appropriate gap therebetween. The light-sensitive element 11 is rotated while supplying the dispersion 12*b* of thermoplastic resin grains into the gap and applying an electric voltage across the gap from an external power source (not shown), whereby the grains are deposited over the entire image-forming areas of the surface of the light-sensitive element 11.

The dispersion 12*b* of thermoplastic resin grains excessively adhered to the surface of the light-sensitive element 11 is removed by a squeezing device built in the electrodeposition unit 14T, and the light-sensitive element is dried by passing under the suction/exhaust unit 15. Then the thermoplastic resin grains are fused by the pre-heating means 17*a* and thus a transfer layer 12 in the form of thermoplastic resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

After moving away the electrodeposition unit 14T, the liquid developing unit set 14 is posited. The unit set 14 is provided with developing units containing yellow, magenta, cyan and black liquid developers respectively. The unit may be provided, if desired, with a pre-bathing means, a rinsing means and/or a squeezing means in order to prevent stains of the non-image portions. As the pre-bathing solution and the rinse solution, a carrier liquid for the liquid developer is generally used.

Then the electrophotographic process and the transfer process are subsequently effected. These processes are the same as those described above in conjunction with the example where the hot-melt coating method is used. Also, other conditions related to the apparatus are the same as those described above.

FIG. 3 is a schematic view of a still another apparatus for forming an electrophotographic transfer image suitable for carrying out the method of the present invention, in which the transfer layer is formed by the transfer method.

The apparatus of FIG. 3 has essentially the same constitution as the apparatus (FIG. 1) used in the hot-melt coating method described above except for means for forming the transfer layer on the surface of light-sensitive element. The electrophotographic process, the transfer process and the conditions thereof performed after forming the transfer layer 12 on the surface of light-sensitive element 11 are also the same as those described above.

In FIG. 3, the apparatus separately provided with a transfer means 117 for transferring the transfer layer 12 from release paper 10 onto the light-sensitive element 11 and a transfer means 17 for transferring the transfer layer having a toner image thereon onto the receiving material 16 is shown. However, a method wherein the transfer layer 12 is first transferred from the release paper 10 to the light-sensitive element using the transfer means 117, a toner image is formed thereon by an electrophotographic process and then the toner image is transferred to the receiving material 16 together with the transfer layer using again the transfer means 117 while now supplying the receiving material 16 can also be employed.

Explanation of the Symbols

Figure 1:
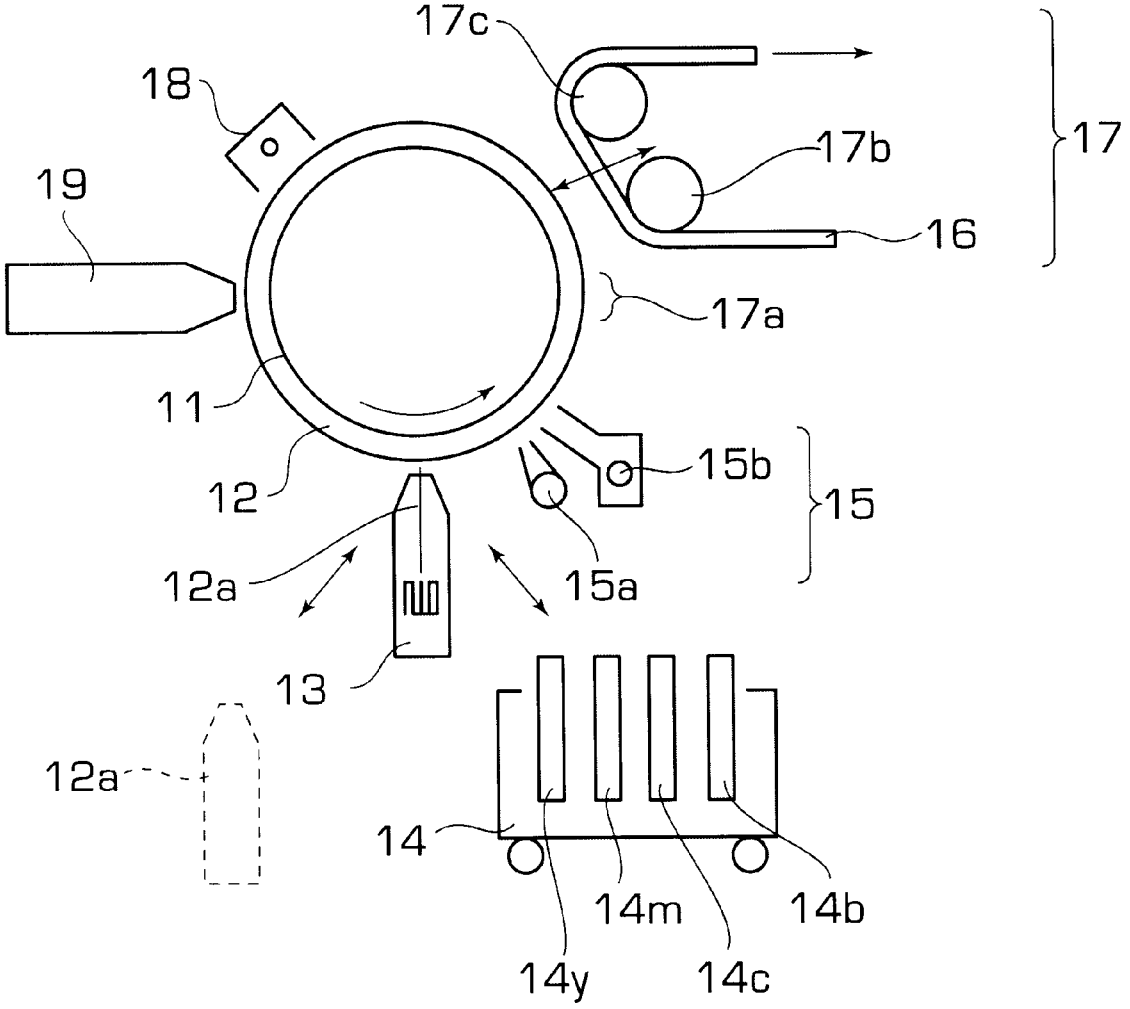
FIG. 1 is a schematic view of an apparatus for forming an electrophotographic transfer -image using the hot-melt coating method for the formation of transfer layer.

10 Release paper
11 Light-sensitive element
12 Transfer layer
12*a* Thermoplastic resin
12*b* Dispersion of thermoplastic resin grains
13 Hot-melt coater
13*a* Stand-by position of hot-melt coater
14 Liquid developing unit set
14T Electrodeposition unit
14*y* Yellow liquid developing unit
14*m* Magenta liquid developing unit
14*c* Cyan liquid developing unit
14*b* Black liquid developing unit
15 Suction/exhaust unit
15*a* Suction part
15*b* Exhaust part
16 Receiving material
17 Heat transfer means
17*a* Pre-heating means
17*b* Heating roller
17*c* Cooling roller
18 Corona charger

19 Exposure device
117 Heat transfer-means
117*b* Heating roller
117*c* Cooling roller

BEST MODE FOR CONDUCTING THE INVENTION

The present invention is illustrated in greater detail with reference to the following examples but the present invention is not to be construed as being limited thereto.

Synthesis

Examples of Thermoplastic Resin Grain (TL):

SYNTHESIS EXAMPLE 1 OF THERMOPLASTIC RESIN GRAIN (TL): (TL-1)

A mixed solution of 10 g of Dispersion Stabilizing Resin (Q-1) having the structure shown below, 98 g of vinyl acetate, 2 g of stearyl methacrylate and 384 g of Isopar H was heated to a temperature of 70° C. under nitrogen gas stream while stirring. To the solution was added 0.8 g of 2,2'-azobis(isovaleronitrile) (abbreviated as AIVN) as a polymerization initiator, followed by reacting for 3 hours. Twenty minutes after the addition of polymerization initiator, the reaction mixture became white turbid, and the reaction temperature rose to 88° C. Then, 0.5 g of the above-described initiator was added to the reaction mixture, the reaction were carried out for 2 hours. The temperature was raised to 100° C. and stirred for 2 hours to remove the unreacted vinyl acetate by distillation. After cooling, the reaction mixture was passed through a nylon cloth of 200 mesh to obtain a white dispersion which was a monodispersed latex with a polymerization ratio of 90% and an average grain diameter of 0.23 μm. The grain diameter was measured by CAPA-500 manufactured by Horiba Ltd. (hereinafter the same).

Dispersion Stabilizing Resin (Q-1)

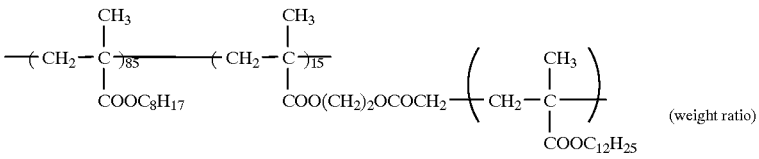

Mw $3.6 \times 10^4$

SYNTHESIS EXAMPLE 2 OF THERMOPLASTIC RESIN GRAIN (TL): (TL-2)

(i) Synthesis of Dispersion Stabilizing Resin (Q-2)

A mixed solution of 99.5 g of dodecyl methacrylate, 0.5 g of divinyl benzene and 200 g of toluene was heated to a temperature of 80° C. under nitrogen gas stream while stirring. To the solution was added 2 g of 2,2'-azobis (isobutyronitrile) (abbreviated as AIBN), followed by reacting for 3 hours. Then, 0.5 g of AIBN was added thereto, followed by reacting for 4 hours. A solid content of the resulting polymer was 33.3% by weight and an Mw thereof was $4\times10^4$.

(ii) Synthesis of Resin Grain

The same reaction procedure as in Synthesis Example 1 of thermoplastic Resin Grain (TL) above was repeated except for using a mixed solution of 16 g of Dispersion Stabilizing Resin (Q-2) above, 100 g of vinyl acetate and 350 g of Isopar H to obtain a white dispersion which was a monodispersed latex with a polymerization ratio of 93% and an average grain diameter of 0.22 μm.

SYNTHESIS EXAMPLE 3 OF THERMOPLASTIC RESIN GRAIN (TL): (TL-3)

The same reaction procedure as in Synthesis Example 1 of thermoplastic Resin Grain (TL) above was repeated except for using a mixed solution of 18 g of Dispersion Stabilizing Resin (Q-3) having the structure shown below, 40 g of methyl methacrylate, 40 g of methyl acrylate, 20 g of styrene and 388 g of Isopar G to obtain a white dispersion which was a monodispersed latex with a polymerization ratio of 95% and an average grain diameter of 0.26 μm.

Dispersion Stabilizing Resin (Q-3)

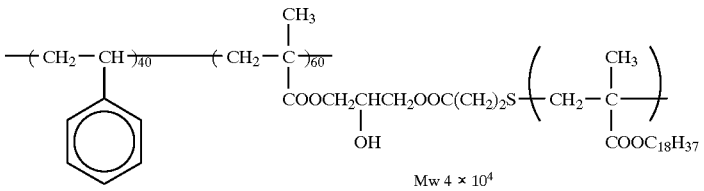

Mw $4 \times 10^4$

SYNTHESIS EXAMPLE 4 OF THERMOPLASTIC RESIN GRAIN (TL): (TL-4)

The same reaction procedure as in Synthesis Example 1 of thermoplastic Resin Grain (TL) above was repeated except for using a mixed solution of 10 g of Dispersion Stabilizing Resin (Q-4) having the structure shown below, 95 g of vinyl acetate, 5 g of crotonic acid and 390 g of Isopar H to obtain a white dispersion which was a monodispersed latex with a polymerization ratio of 88% and an average grain diameter of 0.18 μm.

Dispersion Stabilizing Resin (Q-4)

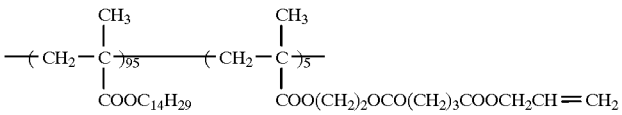

SYNTHESIS EXAMPLES 5 TO 11 OF THERMOPLASTIC RESIN GRAIN (TL): (TL-5) TO (TL-11)

Each of Thermoplastic Resin Grains (TL-5) to (TL-11) was synthesized in the same manner as in Synthesis Example 1 of Thermoplastic Resin Grain (TL) above except for using each of the dispersion stabilizing resins and the monomers shown in Table 2 below in place of Dispersion Stabilizing Resin (Q-1), vinyl acetate and stearyl methacrylate employed in Synthesis Example 1 of Thermoplastic Resin Grain (TL). A polymerization ratio of each of the resulting latexes was in a range of from 85 to 90%, and an average grain diameter thereof was in a range of from 0.15 to 0.25 μm with good monodispersity.

TABLE 2

Dispersion Stabilizing Resin (Q)

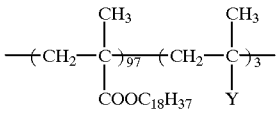

(Mw of each Dispersion Stabilizing Resin (Q) was in a range of from $3 \times 10^4$ to $5 \times 10^4$)

| Synthesis Example of Thermoplastic Resin Grains (TL) | Thermo-plastic Resin Grain (TL) | Chemical Structure of Y in Dispersion Stabilizing Resin (Q) | Amount | Monomer | Amount |
|---|---|---|---|---|---|
| 5 | TL-5 | (Q-5) 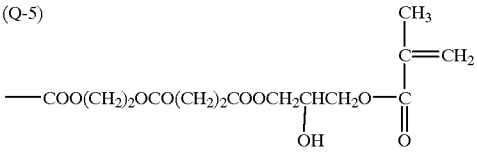 | 12 g | Methyl methacrylate<br>Methyl acrylate | 60 g<br>40 g |
| 6 | TL-6 | (Q-6)<br>—$CONH(CH_2)_{11}COOH{=}CH_2$ | 8 g | Vinyl acetate<br>Styrene | 80 g<br>20 g |
| 7 | TL-7 | (Q-7) 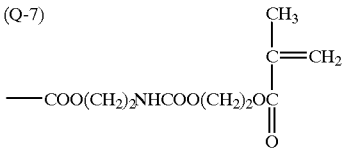 | 12 g | Methyl methacrylate<br>n-Propyl methacrylate | 50 g<br>50 g |
| 8 | TL-8 | (Q-8)<br>—$COO(CH_2)_{10}COOCH_2{-}CH{=}CH_2$ | 10 g | Vinyl acetate<br>Vinyl benzoate | 40 g<br>60 g |

TABLE 2-continued

Dispersion Stabilizing Resin (Q)

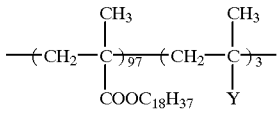

(Mw of each Dispersion Stabilizing Resin (Q) was in a range of from $3 \times 10^4$ to $5 \times 10^4$)

| Synthesis Example of Thermoplastic Resin Grains (TL) | Thermo-plastic Resin Grain (TL) | Chemical Structure of Y in Dispersion Stabilizing Resin (Q) | Amount | Monomer | Amount |
|---|---|---|---|---|---|
| 9 | TL-9 | (Q-9) 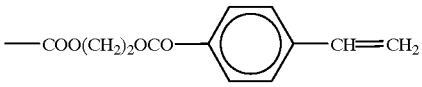 | 15 g | Styrene<br>Vinyl toluene | 40 g<br>60 g |
| 10 | TL-10 | (Q-10) 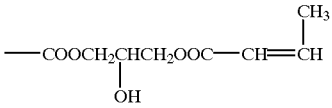 | 14 g | Vinyl acetate<br>Vinylacetic acid | 97 g<br>3 g |
| 11 | TL-11 | (Q-11) 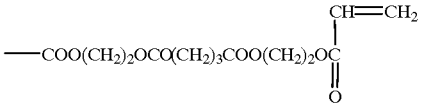 | 12 g | Methyl methacrylate<br>Octyl acrylate | 90 g<br>10 g |

SYNTHESIS EXAMPLES OF RESIN (P):

SYNTHESIS EXAMPLE 1 OF RESIN (P): (P-1)

A mixed solution of 80 g of methyl methacrylate, 20 g of a dimethylsiloxane macromonomer (FM-0725 manufactured by Chisso Corp.; weight average molecular weight (MW): $1\times10^4$), and 200 g of toluene was heated to a temperature of 75° C. under nitrogen gas stream. To the solution was added 1.0 g of AIBN, followed by reacting for 4 hours. To the mixture was further added 0.7 g of AIBN, and the reaction was continued for 4 hours. An Mw of the copolymer thus-obtained was $5.8\times10^4$ (as measured by a GPC method).

Resin (P-1)

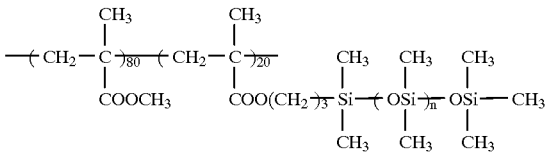

SYNTHESIS EXAMPLES 2 TO 9 OF RESIN (P); (P-2) TO (P-9)

Each of copolymers was synthesized in the same manner as in Synthesis Example 1 of Resin (P), except for replacing methyl methacrylate and the macromonomer (FM-0725) with each monomer corresponding to the polymer component shown in Table 3 below. An Mw of each of the resulting polymers was in a range of from $4.5\times10^4$ to $6\times10^4$.

TABLE 3
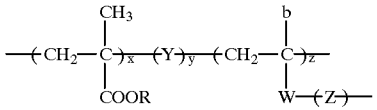
| Synthesis Example of Resin (P) | Resin (P) | —R | —Y— | —b | —W— | —Z— | x/y/z (weight ratio) |
|---|---|---|---|---|---|---|---|
| 2 | P-2 | $—C_2H_5$ | 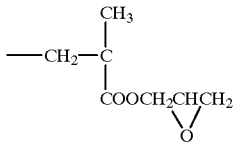 | $—CH_3$ | $—COO(CH_2)_2S—$ | 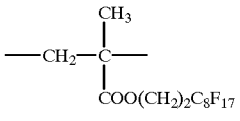 | 65/15/20 |
| 3 | P-3 | $—CH_3$ | 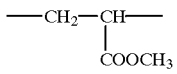 | —H | 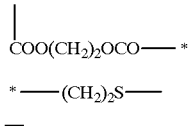 | 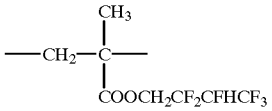 | 60/10/30 |
| 4 | P-4 | $—CH_3$ | 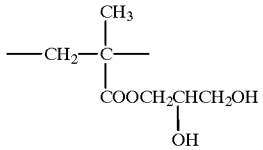 | $—CH_3$ | 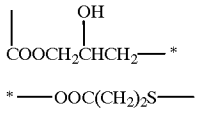 | 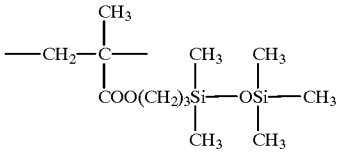 | 65/10/25 |
| 5 | P-5 | $—C_3H_7$ | 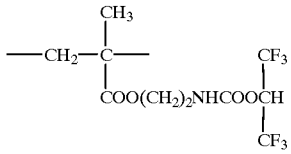 | $—CH_3$ | 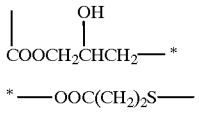 | 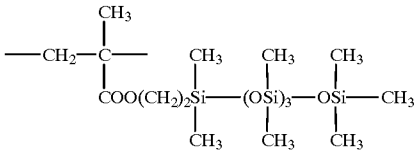 | 65/15/20 |

TABLE 3-continued
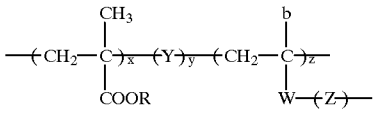
| Synthesis Example of Resin (P) | Resin (P) | —R | —Y— | —b | —W— | —Z— | x/y/z (weight ratio) |
|---|---|---|---|---|---|---|---|
| 6 | P-6 | $—CH_3$ | 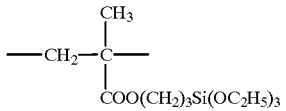 | $—CH_3$ | 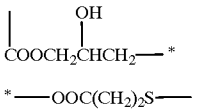 | 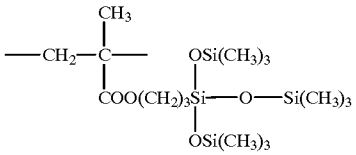 | 50/20/30 |
| 7 | P-7 | $—C_2H_5$ | 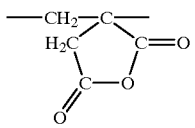 | —H | $—CONH(CH_2)_2S—$ | 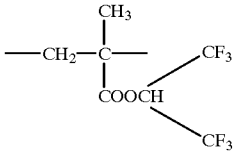 | 57/8/35 |
| 8 | P-8 | $—CH_3$ | 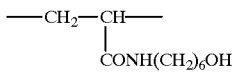 | —H | 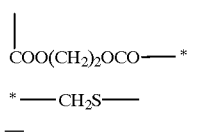 | 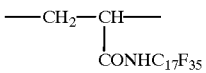 | 70/15/15 |
| 9 | P-9 | $—C_2H_5$ | 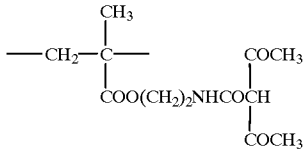 | $—CH_3$ | 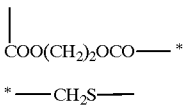 | 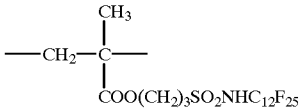 | 70/10/20 |

SYNTHESIS EXAMPLE 10 OF RESIN (P): (P-10)

A mixed solution of 60 g of 2,2,3,4,4,4-hexa-fluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

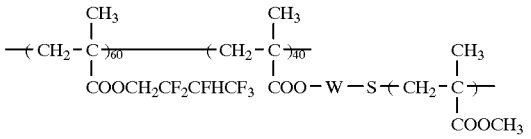

—W—: an organic residue (unknown)

SYNTHESIS EXAMPLES 11 TO 15 OF RESIN (P):

(P-11) TO (P-15)

Each of copolymers was synthesized in the same manner as in Synthesis Example 10 of Resin (P), except for replacing the monomer and the macromonomer used in Synthesis Example 10 of Resin (P) with each monomer and each macromonomer both corresponding to the polymer components shown in Table 4 below. An Mw of each of the resulting copolymers was in a range of from $4.5\times10^4$ to $6.5\times10^4$.

TABLE 4
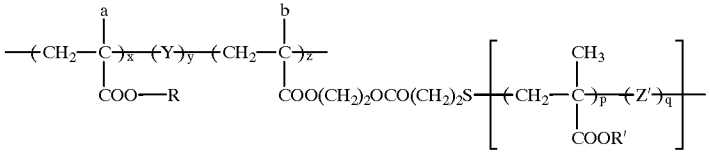
| Synthesis Example of Resin (P) | Resin (P) | —a | —R | —Y— | —b | —R' | —Z'— | x/y/z (weight ratio) | p/q (weight ratio) |
|---|---|---|---|---|---|---|---|---|---|
| 11 | P-11 | $—CH_3$ | $—(CH_2)_2C_nF_{2n+1}$ n = 8~10 | — | $—CH_3$ | $—CH_3$ | 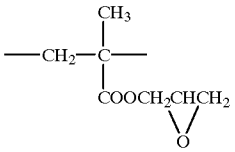 | 70/0/30 | 70/30 |
| 12 | P-12 | $—CH_3$ | $—(CH_2)_2CF_2CFHCF_3$ | — | —H | $—CH_3$ | 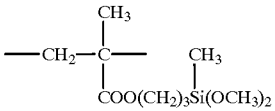 | 60/0/40 | 70/30 |
| 13 | P-13 | $—CH_3$ | $—CH_2CF_2CF_2H$ | 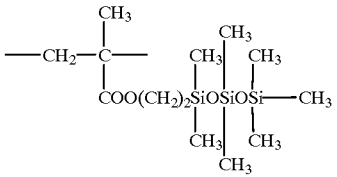 | $—CH_3$ | $—C_3H_7$ | 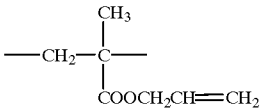 | 40/30/30 | 90/10 |

TABLE 4-continued
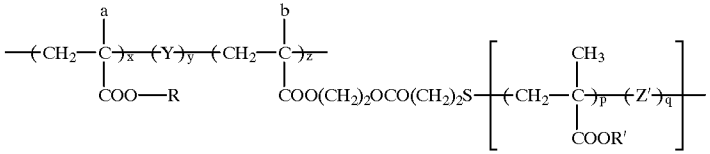
| Synthesis Example of Resin (P) | Resin (P) | —a | —R | —Y— | —b | —R' | —Z'— | x/y/z (weight ratio) | p/q (weight ratio) |
|---|---|---|---|---|---|---|---|---|---|
| 14 | P-14 | —H | $—CH_2CF_2CFHCF_3$ | 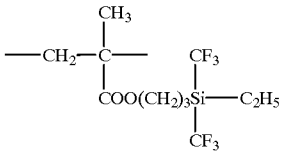 | $—CH_3$ | $—C_2H_5$ | 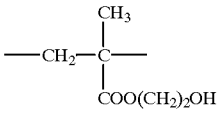 | 30/45/25 | 60/40 |
| 15 | P-15 | $—CH_3$ | | 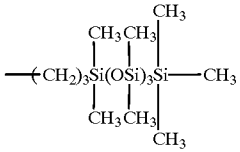 | — | $—CH_3$ | $—C_2H_5$ | 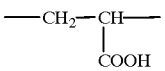 80/0/20 | 90/10 |

SYNTHESIS EXAMPLE 16 OF RESIN (P): (P-16)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Monomer (M-1)

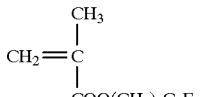

Resin (P-17)

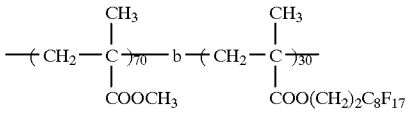

Polymer Initiator (PI-1)

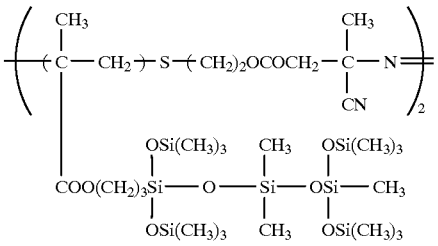

Polymer (P-16)

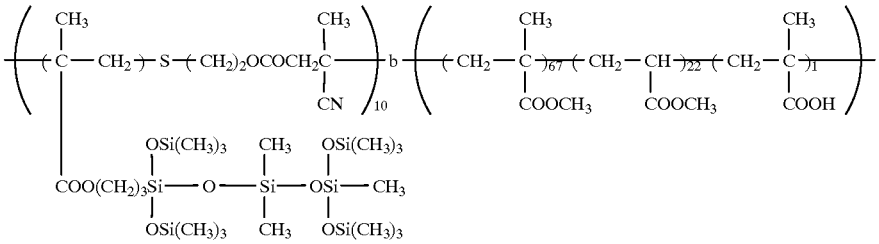

-b-: a bond between blocks

SYNTHESIS EXAMPLE 17 OF RESIN (P): (P-17)

A mixed solution of 70 g of methyl methacrylate and 200 g of tetrahydrofuran was thoroughly degassed under nitrogen gas stream and cooled to −20° C. To the solution was added 0.8 g of 1,1-diphenylbutyl lithium, followed by reacting for 12 hours. To the reaction mixture was then added a mixed solution of 30 g of Monomer (M-1) shown below and 60 g of tetrahydrofuran which had been thoroughly degassed under nitrogen gas stream, followed by reacting for 8 hours.

After rendering the mixture to 0° C., 10 ml of methanol was added thereto to conduct a reaction for 30 minutes to stop the. polymerization. The resulting polymer solution was heated to a temperature of 30° C. with stirring, and 3 ml of a 30% ethanol solution of hydrogen chloride was added thereto, followed by stirring for 1 hour. The reaction mixture was distilled under reduced pressure to remove the solvent until the volume was reduced to half and the residue was reprecipitated in 1 l of petroleum ether. The precipitate was collected and dried under reduced pressure to obtain 76 g of a polymer having an Mw of $6.8\times10^4$.

SYNTHESIS EXAMPLE 18 OF RESIN (P): (P-18)

A mixed solution of 52.5 g of methyl methacrylate, 22.5 g of methyl acrylate, 0.5 g of methylaluminum tetraphenylporphynate, and 200 g of methylene chloride was heated to a temperature of 30° C. under nitrogen gas stream. The solution. was irradiated with light from a xenon lamp of 300 W at a distance of 25 cm through a glass filter for 20 hours. To the mixture was added 25 g of Monomer (M-2) shown below, and the resulting mixture was further irradiated with light under the same conditions as above for 12 hours. To the reaction mixture was added 3 g of methanol, followed by stirring for 30 minutes to stop the reaction. The reaction mixture was reprecipitated in 1.5 l of methanol, and the precipitate was collected and dried to obtain 78 g of a polymer having an Mw of $9\times10^4$.

Monomer (M-2)

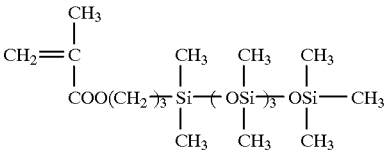

Resin (P-18)

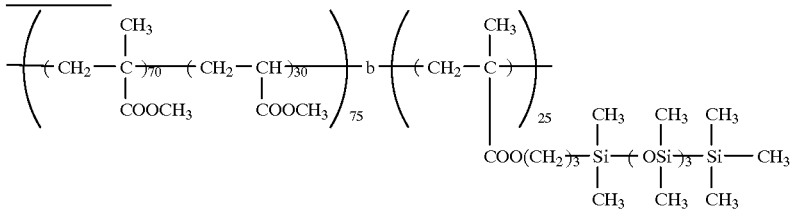

SYNTHESIS EXAMPLE 19 OF RESIN (P): (P-19)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photo-polymerization. The reaction mixture was dissolved in 100 g of tetrahydrofuran, and 40 g of Monomer (M-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (M-3)

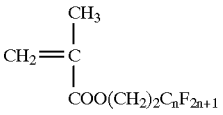

(n: an integer of from 8 to 10)

Resin (P-19)

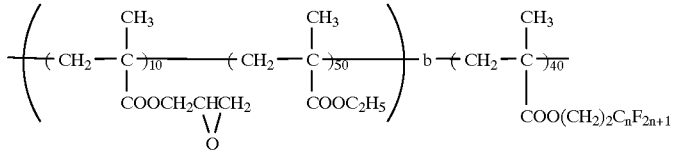

(n: an integer of from 8 to 10)

SYNTHESIS EXAMPLE 20 OF RESIN (P): (P-20)

A mixture of 50 g of methyl methacrylate, 25 g of ethyl methacrylate, and 1.0 g of benzyl isopropylxanthate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. To the mixture was added 25 g of Monomer (M-1) described above. After displacing the atmosphere with nitrogen, the mixture was again irradiated with light for 10 hours. The reaction mixture obtained was reprecipitated in 2 l of methanol, and the precipitate was collected and dried to obtain 63 g of a polymer having an Mw of $6\times10^4$.

Resin (P-20)
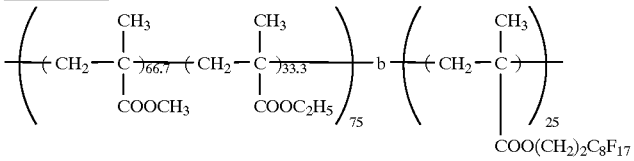
SYNTHESIS EXAMPLES 21 TO 27 OF RESIN (P):
(P-21) TO (P-27)
Each copolymers shown in Table 5 below was prepared in the same manner as in Synthesis Example 19 of Resin (P). An Mw of each of the resulting polymers was in a range of from $3.5\times10^4$ to $6\times10^4$.
TABLE 5
| Synthesis Example of Resin (P) | Resin (P) | A-B Type Block Copolymer (weight ratio) |
|---|---|---|
| 21 | P-21 | 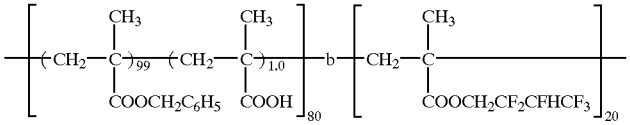 |
| 22 | P-22 | 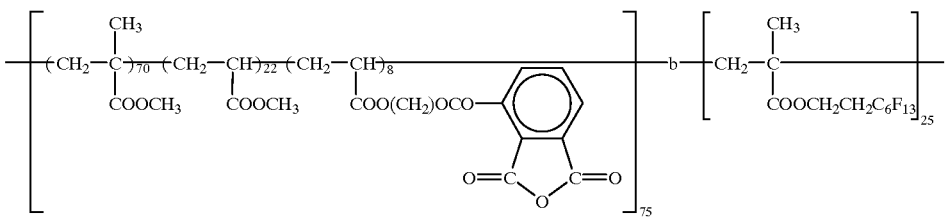 |
| 23 | P-23 | 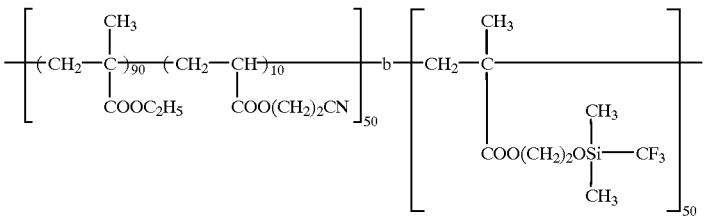 |
| 24 | P-24 | 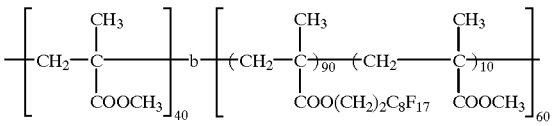 |

TABLE 5-continued

| Synthesis Example of Resin (P) | Resin (P) | A-B Type Block Copolymer (weight ratio) |
|---|---|---|
| 25 | P-25 | 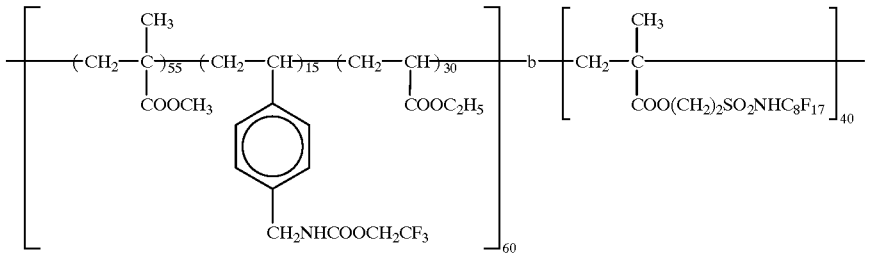 |
| 26 | P-26 | 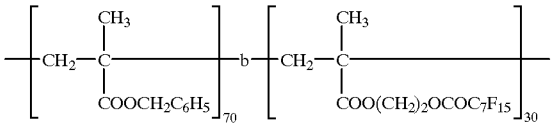 |
| 27 | P-27 | 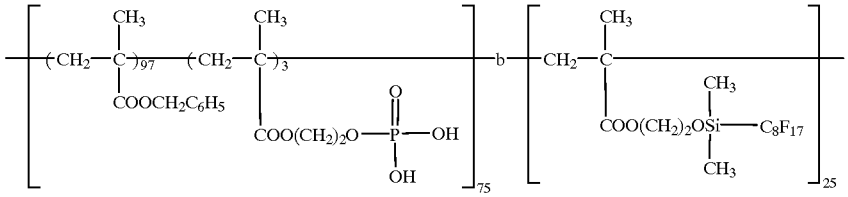 |

SYNTHESIS EXAMPLE 28 OF RESIN (P): (P-28)

A copolymer having an Mw of $4.5\times10^4$ was prepared in the same manner as in Synthesis Example 19 of Resin (P), except for replacing benzyl N,N-diethyldithiocarbamate with 18 g of Initiator (I-1) having the structure shown below.

Initiator (I-1)

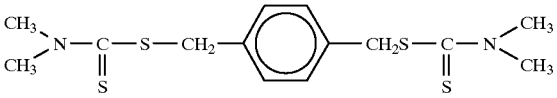

Resin (P-28)

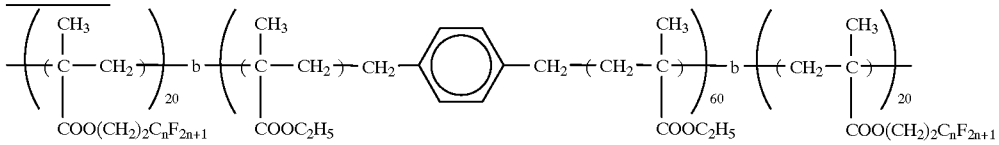

(n: an integer of from 8 to 10)

SYNTHESIS EXAMPLE 29 OF RESIN (P): (P-29)

A copolymer having an Mw of $2.5\times10^4$ was prepared in the same manner as in Synthesis Example 20 of Resin (P), except for replacing benzyl isopropylxanthate with 0.8 g of Initiator (I-2) having the structure shown below.

Initiator (I-2)

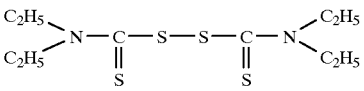

Resin (P-29)

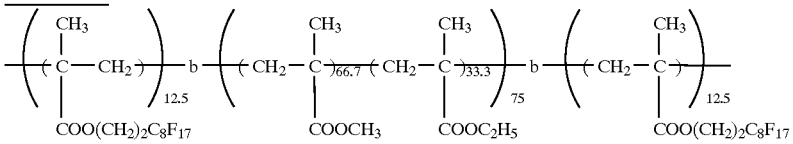

SYNTHESIS EXAMPLE 30 OF RESIN (P): (P-30)

A mixed solution of 68 g of methyl methacrylate, 22 g of methyl acrylate, 10 g of glycidyl methacrylate, 17.5 g of Initiator (I-3) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (M-2) described above, and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-3)

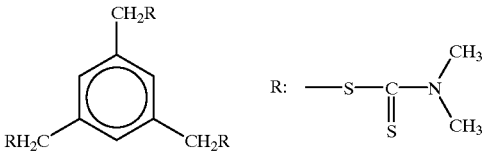

Resin (P-30)

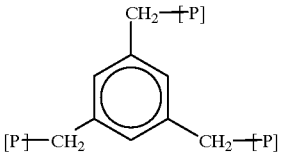

-continued

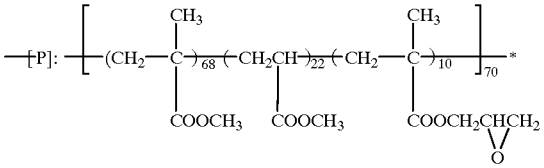

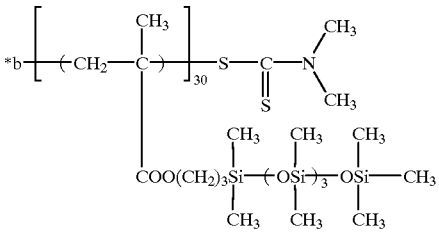

SYNTHESIS EXAMPLES 31 TO 38 OF RESIN (P):

(P-31) TO (P-38)

In the same manner as in Synthesis Example 30 of Resin (P), except for replacing 17.5 g of Initiator (I-3) with 0.031 mol of each of the initiators shown in Table 6 below, each of the copolymers shown in Table 6 was obtained. A yield thereof was in a range of from 70 to 80 g and an Mw thereof was in a range of from $4\times10^4$ to $6\times10^4$.

TABLE 6
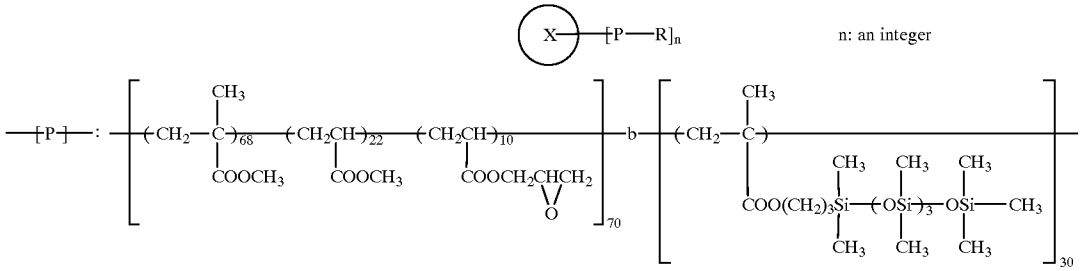
n: an integer
| Synthesis Example of Resin (P) | Resin (P) | Initiator (I) | | —R | — |
|---|---|---|---|---|---|
| 31 | P-31 | 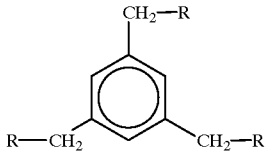 | (I-4) | 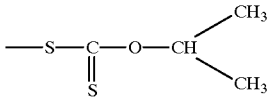 | 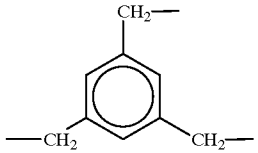 |
| 32 | P-32 | 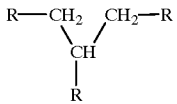 | (I-5) | 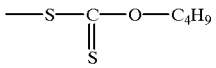 | 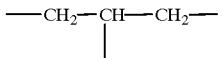 |
| 33 | P-33 | 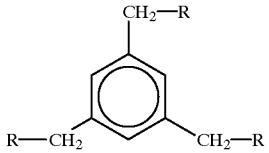 | (I-6) | 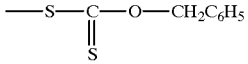 | 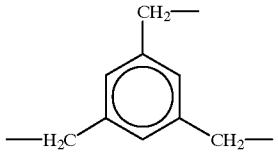 |

TABLE 6-continued
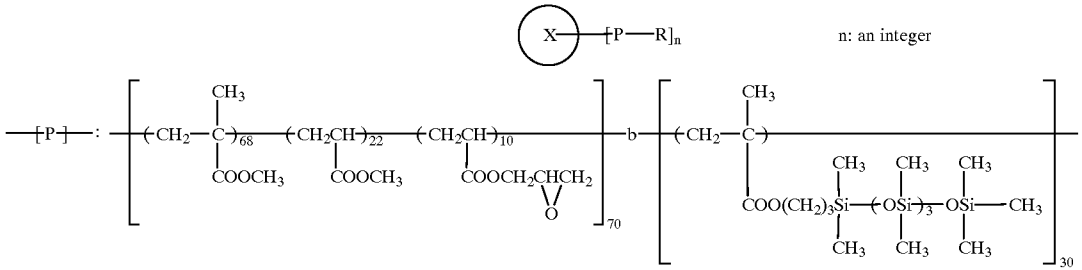
| Synthesis Example of Resin (P) | Resin (P) | Initiator (I) | | —R | — |
|---|---|---|---|---|---|
| 34 | P-34 | 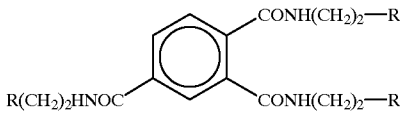 | (I-7) | 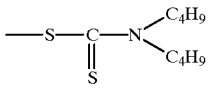 | 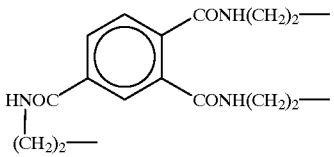 |
| 35 | P-35 | 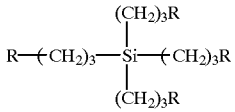 | (I-8) | 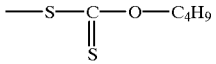 | 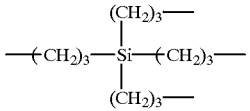 |
| 36 | P-36 | 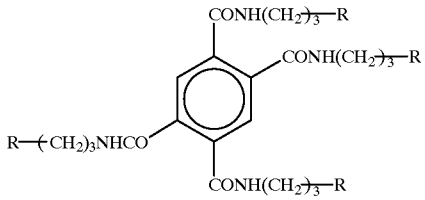 | (I-9) | 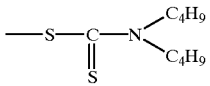 | 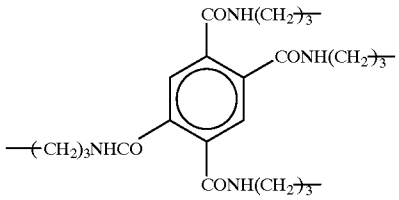 |

TABLE 6-continued
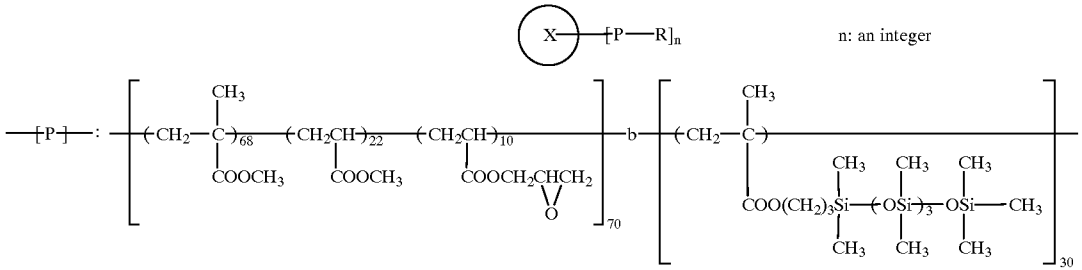
| Synthesis Example of Resin (P) | Resin (P) | Initiator (I) | | —R | — |
|---|---|---|---|---|---|
| 37 | P-37 | 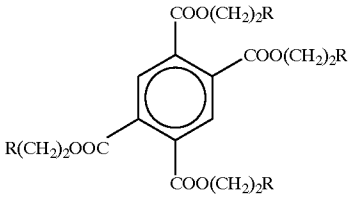 | (I-10) | 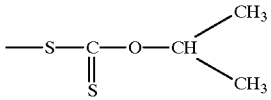 | 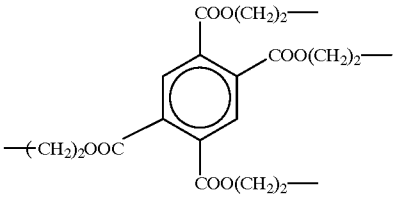 |
| 38 | P-38 | 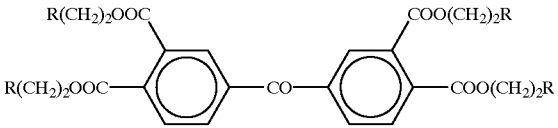 | (I-11) | 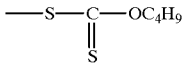 | 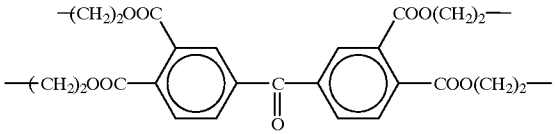 |

SYNTHESIS EXAMPLES OF RESIN GRAIN (L):

SYNTHESIS EXAMPLE 1 OF RESIN GRAIN (L) : (L-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of 2,2'-azobis(isovaleronitrile) (abbreviated as AIVN), followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm (the grain diameter was measured by CAPA-500 manufactured by Horiba, Ltd.).

Monomer (LM-1)

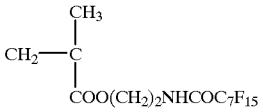

Dispersion Stabilizing Resin (LP-1)

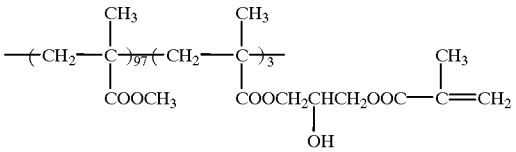

Mw: $3 \times 10^4$ (weight ratio)

SYNTHESIS EXAMPLE 2 OF RESIN GRAIN (L) : (L-2)

A mixed solution of 5 g of AB-6 (a monofunctional macromonomer comprising a butyl acrylate unit, manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

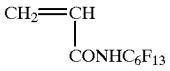

SYNTHESIS EXAMPLES 3 TO 11 OF RESIN GRAIN (L): (L-3) TO (L-11)

Each of resin grains was synthesized in the same manner as in Synthesis Example 1 of Resin Grain (L) , except for replacing Monomer (LM-1), ethylene glycol dimethacrylate and methyl ethyl ketone with each of the compounds shown in Table 7 below, respectively. An average grain diameter of each of the resulting resin grains was in a range of from 0.15 to 0.30 μm.

TABLE 7

| Synthesis Example of Resin Grain (L) | Resin Grain (L) | Monomer (LM) | | Crosslinking Poly-functional Monomer | Amount | Reaction Solvent |
|---|---|---|---|---|---|---|
| 3 | L-3 | 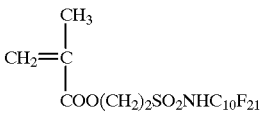 | (LM-3) | Ethylene glycol dimethacrylate | 2.5 g | Methyl ethyl ketone |
| 4 | L-4 | 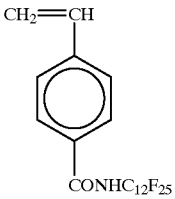 | (LM-4) | Divinylbenzene | 3 g | Methyl ethyl ketone |
| 5 | L-5 | 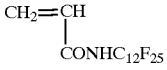 | (LM-5) | — | | Methyl ethyl ketone |
| 6 | L-6 | 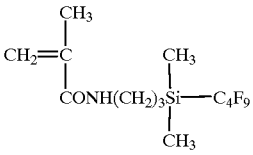 | (LM-6) | Diethylene glycol diacrylate | 5 g | n-Hexane |

TABLE 7-continued

| Synthesis Example of Resin Grain (L) | Resin Grain (L) | Monomer (LM) | | Crosslinking Poly-functional Monomer | Amount | Reaction Solvent |
|---|---|---|---|---|---|---|
| 7 | L-7 | 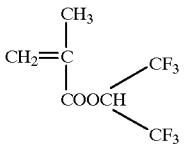 | (LM-7) | Ethylene glycol dimethacrylate | 3.5 g | n-Hexane |
| 8 | L-8 | $CH_2{=}CH$ \| $COO(CH_2)_2CONHC_8F_{17}$ | (LM-8) | Trimethylolpropane trimethacrylate | 2.5 g | Methyl ethyl ketone |
| 9 | L-9 | $CH_2{=}CH$ \| $CONH(CH_2)_3Si[OSi(CH_3)_3]_3$ | (LM-9) | Trivinylbenzene | 3.3 g | Ethyl acetate/ Hexane (4/1 by weight) |
| 10 | L-10 | $CH_2{=}C(CH_3)$ \| $COO(CH_2)_2NHCONH(CH_2)_3Si[OSi(CH_3)_3]_3$ | (LM-10) | Divinyl glutaconate | 4 g | Ethyl acetate/ n-Hexane (2/1 by weight) |
| 11 | L-11 | $CH_2{=}C(CH_3)$ \| $CONHCOOCH_2CF_2CFHCF_3$ | (LM-11) | Propylene glycol diacrylate | 3 g | Methyl ethyl ketone |

SYNTHESIS EXAMPLES 12 TO 17 OF RESIN GRAIN (L): (L-12) TO (L-17)

Each of resin grains was synthesized in the same manner as in Synthesis Example 2 of Resin Grain (L) , except for replacing 5 g of AB-6 (dispersion stabilizing resin) with each of Resins (LP) shown in Table 8 below. An average grain diameter of each of the resulting resin grains was in a range of from 0.10 to 0.25 $\mu$m.

TABLE 8

| Synthesis Example of Resin Grain (L) | Resin Grain (L) | Dispersion Stabilizing Resin (LP) | Amount |
|---|---|---|---|
| 12 | L-12 | 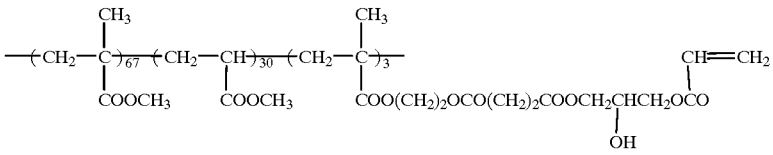 (LP-2) Mw $3.3 \times 10^4$ | 4 g |
| 13 | L-13 | 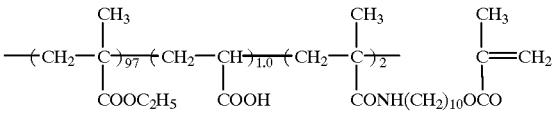 (LP-3) Mw $2.5 \times 10^4$ | 2 g |

TABLE 8-continued

| Synthesis Example of Resin Grain (L) | Resin Grain (L) | Dispersion Stabilizing Resin (LP) | Amount |
|---|---|---|---|
| 14 | L-14 | 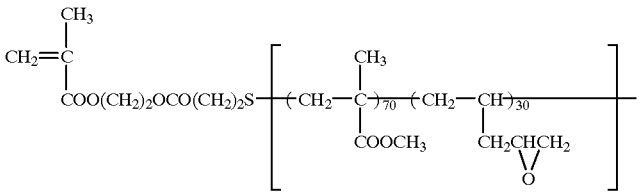 (LP-4) Mw 8 × $10^3$ | 6 g |
| 15 | L-15 | 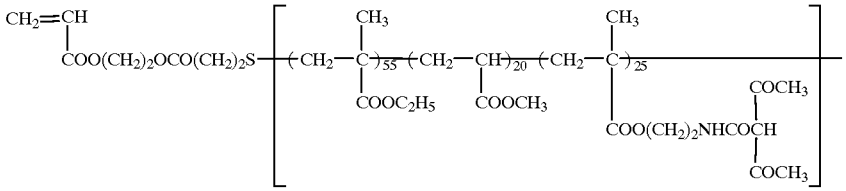 (LP-5) Mw 1 × $10^4$ | 6 g |
| 16 | L-16 | 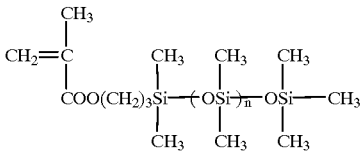 (LP-6) Mw 1 × $10^4$ | 4 g |
| 17 | L-17 | 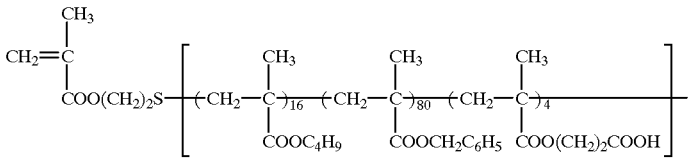 (LP-7) Mw 6 × $10^3$ | 5 g |

SYNTHESIS EXAMPLES 18 TO 23 OF RESIN GRAIN (L): (L-18) TO (L-23)

Each of resin grains was synthesized in the same manner as in Synthesis Example 2 of Resin Grain (L), except for replacing 40 g of Monomer (LM-2) with each of the monomers shown in Table 9 below and replacing 5 g of AB-6 (dispersion stabilizing resin) with 6 g of Dispersion Stabilizing Resin (LP-8) having the structure shown below. An average grain diameter of each of the resulting resin grains was in a range of from 0.05 to 0.20 $\mu$m.

Dispersion Stabilizing Resin (LP-8)

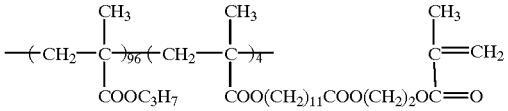

Mw 3 × $10^4$

TABLE 9

| Synthesis Example of Resin Grain (L) | Resin Grain (L) | Monomer (LM) | | Amount | Other Monomer | Amount |
|---|---|---|---|---|---|---|
| 18 | L-18 | $CH_2{=}C(CH_3)COO(CH_2)_2C_8F_{17}$ | (LM-12) | 30 g | $CH_2{=}CH(CONHCH_2OCH_3)$ | 10 g |
| 19 | L-19 | $CH_2{=}C(CH_3)COO(CH_2)_3Si(CH_3)_2(OSi(CH_3)_2)_2OSi(CH_3)_3$ | (LM-13) | 25 g | Glycidyl methacrylate | 15 g |
| 20 | L-20 | $CH_2{=}CH(COOCH_2CF_2CF_2H)$ | (LM-14) | 20 g | Acrylonitrile | 20 g |
| 21 | L-21 | $CH_2{=}CH$ 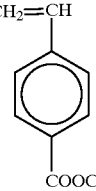 $COOCH_2CH_2C_7F_{15}$ | (LM-15) | 25 g | $CH_2{=}CH$ 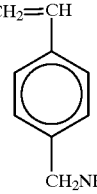 $CH_2NHCOCH(COCH_3)_2$ | 15 g |
| 22 | L-22 | $CH_2{=}C(CH_3)COO(CH_2)_2OSi(CH_3)_2C_6F_{13}$ | (LM-16) | 20 g | Methyl methacrylate | 20 g |
| 23 | L-23 | $CH(CH_3){=}CH(COOCH_2CF_2CFHCF_3)$ | (LM-17) | 20 g | Vinyl acetate | 20 g |

EXAMPLE I-1

An amorphous silicon electrophotographic light-sensitive element was installed in an apparatus as shown in FIG. 1. An ethylene-vinyl acetate copolymer (content of vinyl acetate: 20% by weight; softening point measured by ring and ball method: 90° C.) was coated as a thermoplastic resin on the surface of light-sensitive layer at a rate of 20 mm/sec by a hot melt coater adjusted at 120° C. and cooled by blowing cool air from a suction/exhaust unit, followed by maintaining the surface temperature of light-sensitive element at 30° C. to prepare a transfer layer having a thickness of 3 $\mu$m.

The resulting electrophotographic light-sensitive material (hereinafter, simply referred to as light-sensitive material sometimes) was charged to +700 V with a corona discharge in a dark place and exposed to light using a semiconductor laser having an oscillation wavelength of 780 nm on the basis of digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc. The potential in the exposed area was +220 V while it was +600 V in the unexposed area.

The exposed light-sensitive material was pre-bathed with Isopar H (manufactured by Esso Standard Oil Co.) by a pre-bathing means installed in a developing unit and then subjected to reversal development by supplying a liquid developer prepared by diluting a positively charged yellow toner for an electrostatic color plotter (Versateck 3000 manufactured by Xerox Corp.) with 50-fold Isopar H from the developing unit to the surface of light-sensitive material while applying a bias voltage of +500 V to the developing unit side to thereby electrodeposite yellow toner particles on the unexposed areas. The light-sensitive material was then rinsed in a bath of Isopar H alone to remove stains in the non-image areas and dried by a suction/exhaust unit.

The above procedure was repeated using each information for magenta, cyan and black in place of the information for yellow.

The light-sensitive material having yellow, magenta, cyan and black toner images on the transfer layer thereof was passed under an infrared line heater to maintain a surface temperature thereof measured by a radiation thermometer at about 80° C. and brought into contact with coated paper as a receiving material and they were passed between a pair of heating rubber rollers which were in contact with each other under a pressure of 10 kgf/cm$^2$ and whose surface temperature was constantly maintained at 120° C. at a transportation speed of 15 mm/sec.

After cooling the sheets while being in contact with each other by passing under a cooling roller, the coated paper was stripped from the light-sensitive element whereby the toner images on the light-sensitive material were wholly heat-transferred together with the transfer layer onto the coated paper. Further, the toner images were completely covered with the thermoplastic resin of transfer layer on the coated paper and thus they did not fall off when they were rubbed.

EXAMPLES I-2 TO I-17

The procedure for the formation of transfer image same as in Example I-1 was repeated except that each of the resins shown in Table I-1 below was used in place of the thermoplastic resin, i.e., ethylene-vinyl acetate copolymer used in Example I-1. Similar results to those in Example I-1 were obtained.

TABLE I-1

| Example | Thermoplastic Resin |
|---|---|
| I-2 | Cellulose Acetate Butyrate (Cellidor Bsp manufactured by Bayer AG) |
| I-3 | Polyvinyl Butyral Resin (S-Lec manufactured by Sekisui Chemical Co., Ltd. |
| I-4 | Cellulose Propionate (Cellidoria manufacture Daicel Co., Ltd.) |
| I-5 | Polyvinyl Acetate |
| I-6 | Mixture of Vinyl Acetate/Crotonic Acid (95/5 by weight) Copolymer and Cellidor Bsp (8/2 by weight) |
| I-7 | Methyl Methacrylate/Methyl Acrylate (60/40 by weight) Copolymer |
| I-8 | Polypropyl Methacrylate |
| I-9 | Polyvinyl Methyl Ether |
| I-10 | Styrene/Butadiene Copolymer |
| I-11 | Styrene/Butadiene Copolymer (Sorprene 1204 manufactured by Asahi Kasei Kogyo K.K.) |
| I-12 | Polydecamethylene Terephthalate |
| I-13 | Polydecamethylene Isophthalate |
| I-14 | Styrene/vinyl Acetate (20/80 by weight) Copolymer |
| I-15 | Polyhexamethylene Succinate |
| I-16 | Poly-4-methylpentene-1 |
| I-17 | Polypentamethylene Carbonate |

EXAMPLE I-18

A mixture of 1 g of X-form metal-free phthalocyanine (manufactured by Dainippon Ink and Chemicals, Inc.), 10 g of Binder Resin (B-1) having the structure shown below, 0.3 g of Resin (P-1), 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-1)

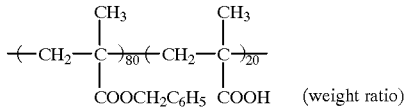

Mw 6.5 × 10$^4$

Compound (A)

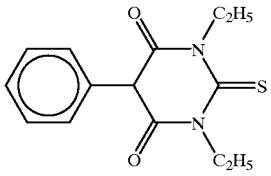

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 5 minutes to form a light-sensitive element comprising a light-sensitive layer having a thickness of 8 $\mu$m.

The resulting light-sensitive element was installed in an apparatus same as in Example I-1. Polyvinyl acetate was coated as a thermoplastic resin on the surface of light-sensitive layer at a rate of 20 mm/sec by a hot melt coater adjusted at 100° C. and cooled by blowing cool air from a suction/exhaust unit, followed by maintaining the surface temperature of light-sensitive element at 30° C. to prepare a transfer layer having a thickness of 2 $\mu$m.

The resulting light-sensitive material was charged to +450 V with a corona discharge in a dark place and exposed to light of a gallium-aluminum-arsenic semiconductor laser (output: 5 mW; oscillation wavelength: 780 nm) at an irradiation dose on the surface of the light-sensitive material of 30 erg/cm$^2$, a pitch of 25 $\mu$m, and a scanning speed of 300 cm/sec. The scanning exposure was in a negative mirror image mode based on digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc.

Thereafter, the exposed light-sensitive material was subjected to reversal development using a liquid developer prepared by diluting a yellow liquid developer for Signature System (manufactured by Eastman Kodak Co.) with 75-fold by weight Isopar H (manufactured by Esso Standard Oil Co.) in a developing machine having a pair of flat development electrodes while a bias voltage of +400 V was applied to the electrode on the side of the light-sensitive material to thereby electrodeposit toner particles on the exposed areas. The light-sensitive material was then rinsed in a bath of Isopar H alone to remove stains in the non-image areas.

The above procedure was repeated using each information for magenta, cyan and black in place of the information for yellow.

The light-sensitive material was then subjected to fixing by means of a heat roller whereby the toner images thus-formed were fixed.

The light-sensitive material having yellow, magenta, cyan and black toner images was brought into contact with coated paper as a receiving material and they were passed between a pair of rubber rollers which were in contact with each other under a pressure of 15 kgf/cm$^2$ and whose surface temperature was constantly maintained at 120° C. at a transportation speed of 10 mm/sec.

After cooling the sheets while being in contact with each other to room temperature, the coated paper was stripped from the light-sensitive element. The color images transferred on coated paper were visually evaluated for fog and image quality.

As a result it was found that the toner images on the light-sensitive material according to the present invention were wholly heat-transferred together with the transfer layer onto the coated paper. The transfer layer had an appropriate matting surface. The duplicated images obtained were clear and free from background stain, and degradation of image quality was not substantially observed when compared with the original. Further, since the toner images were completely covered with the thermoplastic resin of transfer layer on the coated paper, they did not fall off when they were rubbed and the strength of transferred images was sufficiently high.

EXAMPLE I-19

5 g of 4,4'-bis(diethylamino)-2,2'-dimethyltriphenylmethane as an organic photoconductive substance, 4 g of Binder Resin (B-2) having the structure shown below, 0.8 g of Resin (P-3), 40 mg of Dye (D-2) having the structure shown below, and 0.2 g of Anilide Compound (B) having the structure shown below as a chemical sensitizer were dissolved in a mixed solvent of 30 ml of methylene chloride and 30 ml of ethylene chloride to prepare a solution for light-sensitive layer.

Binder Resin (B-2)

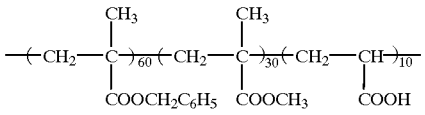

Mw 8 x 10$^4$

Dye (D-2)

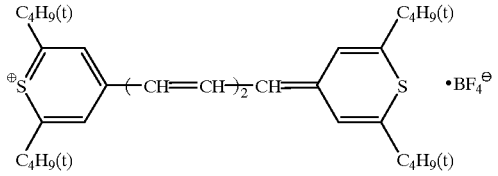

Anilide Compound (B)

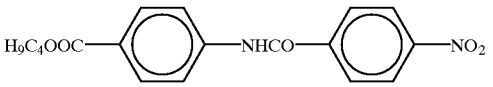

The resulting solution for light-sensitive layer was coated on a conductive transparent substrate composed of a 100 μm-thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

The procedure same as in Example I-18 was repeated except for using the resulting light-sensitive element in place of the light-sensitive element employed in Example I-18 to prepare transferred images. The color images obtained on coated paper were clear and free from background stain and had good image strength.

EXAMPLE I-20

A mixture of 3 g of X-form metal-free phthalocyanine (manufactured by Dainippon Ink and Chemicals, Inc.), 10 g of Binder Resin (B-3) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-3)

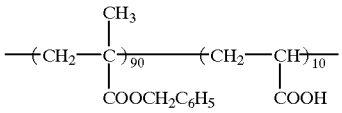

Mw 8×10$^4$

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 30 minutes to form a light-sensitive layer having a thickness of 8 μm.

In order to form an overcoat layer for imparting releasability on the surface of light-sensitive layer, a solution having the composition shown below was prepared.

| Overcoat Solution | |
|---|---|
| Methyl methacrylate/glycidyl methacrylate (80/20 by weight) copolymer (Mw: 6 × 10$^4$) | 3 g |
| Resin (P-2) | 0.15 g |
| Phthalic anhydride | 25 mg |
| o-Chlorophenol | 2 mg |
| Toluene | 100 g |

The solution was coated on the light-sensitive layer with a wire bar at a dry thickness of 2.0 μm, dried in an oven at 100° C. for 20 seconds and then heated at 140° C. for 1 hour. The coated film was allowed to stand in dark at 20° C. and 65% RH for 24 hours to prepare an electrophotographic light-sensitive element.

The procedure same as in Example I-18 was conducted except for using the resulting light-sensitive element in place of the light-sensitive element employed in Example I-18 to prepare transferred images. The color images obtained on coated paper were clear and free from background stain and had good image strength.

EXAMPLE I-21

A mixture of 100 g of photoconductive zinc oxide, 20 g of Binder Resin (B-4) having the structure shown below, 4 g of Resin (P-30), 0.01 g of Dye (D-1) having the structure shown below, 0.1 g of salicylic acid, and 150 g of toluene was disposed in a ball mill for 2 hours to prepare a dispersion for light-sensitive layer.

Binder Resin (B-4)

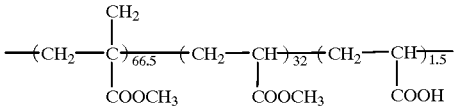

Mw $6.8\times10^4$

Dye (D-1)

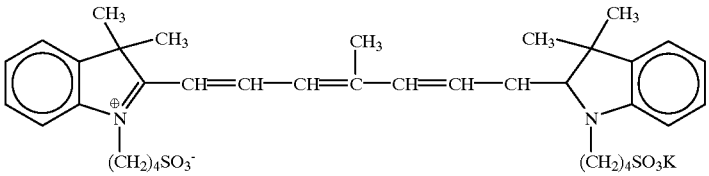

To the dispersion were added 0.1 g of phthalic anhydride and 0.02 g of zirconium acetylacetone, and the mixture was dispersed for 10 minutes.

The resulting dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer.

In order to confirm localization of the block copolymer according to the present invention in the surface portion of the light-sensitive layer, the adhesion strength was measured using an adhesive tape. As a result, it was found that the adhesion strength was reduced to one-fortieth that of a sample which did not contain Resin (P-30).

On the light-sensitive element, a transfer layer was formed in the same manner as in Example I-18.

The resulting light-sensitive material was charged to −600 V with a corona discharge in a dark place and exposed to light using a semiconductor laser having an oscillation wavelength of 780 nm at an irradiation dose of 25 erg/cm$^2$ on the surface of the light-sensitive material in a positive mirror image mode based on an information for yellow color separation of digital image data same as those described in Example I-1. The residual potential of the exposed areas was −120 V. Then, the exposed light-sensitive material was subjected to normal development using a liquid developer prepared by diluting a yellow toner for an electrostatic color plotter (Versateck 3000 manufactured by Xerox Corp.) with 50-fold Isopar H (manufactured by Esso Standard Oil Co.) in a developing machine having a pair of flat development electrodes while a bias voltage of −200 V was applied to the electrode on the side of the light-sensitive material to thereby electrodeposit toner particles on the unexposed areas. The light-sensitive material was then rinsed in a bath of Isopar H alone to remove stains in the non-image areas.

The above procedure was repeated using each information for magenta, cyan and black in place of the information for yellow.

The light-sensitive material having yellow, magenta, cyan and black toner images was brought into contact with coated paper as a receiving material and they were passed between a pair of rubber rollers which were in contact with each other under a pressure of 10 kgf/cm$^2$ and whose surface temperature was constantly maintained at 120° C. at a transportation speed of 6 mm/sec.

After cooling the sheets while being in contact with each other to room temperature, the coated paper was stripped from the light-sensitive element whereby the toner images on the light-sensitive material were wholly heat-transferred together with the transfer layer onto the coated paper. The transfer layer had an appropriate matting surface. The duplicated images obtained were glossy and degradation of image quality was not substantially observed when compared with the original. Further, the toner images were completely covered with the thermoplastic resin of transfer layer on the coated paper and thus they did not fall off when they were rubbed.

EXAMPLES I-22 TO I-41

Each electrophotographic light-sensitive material was prepared in the same manner as in Example I-18 except for using 0.2 g of each of the resins (P) shown in Table I-2 below in place of 0.3 g of Resin (P-1) employed in Example I-18.

TABLE I-2

| Example | Resin (P) |
|---|---|
| I-22 | P-3 |
| I-23 | P-4 |
| I-24 | P-6 |
| I-25 | P-10 |
| I-26 | P-11 |
| I-27 | P-12 |
| I-28 | P-13 |
| I-29 | P-15 |
| I-30 | P-16 |
| I-31 | P-17 |
| I-32 | P-18 |
| I-33 | P-20 |
| I-34 | P-24 |
| I-35 | P-26 |
| I-36 | P-28 |
| I-37 | P-29 |
| I-38 | P-33 |
| I-39 | P-35 |
| I-40 | P-36 |
| I-41 | P-38 |

The image forming performance and transferability of the resulting light-sensitive materials were evaluated in the same manner as in Example I-18. The color duplicated images obtained on coated paper were clear and free from background stain and had good image strength.

EXAMPLE I-42

An electrophotographic light-sensitive material was prepared in the same manner as in Example I-20 except for using 0.3 g (solid basis) of Resin Grain (L-1) in place of 0.15 g of Resin (P-2) employed in Example I-20. Using the resulting light-sensitive material, a color proof was prepared in the same manner as in Example I-20. The color duplicated image obtained was clear and free from background stain.

EXAMPLES I-43 TO I-54

Each electrophotographic light-sensitive material was prepared in the same manner as in Example I-42 except for using 0.3 g (solid basis) of each of the resin grains (L) shown in Table I-3 below in place of 0.3 g of Resin Grain (L-1) employed in Example I-42.

TABLE I-3

| Example | Resin Grain (L) |
|---|---|
| I-43 | L-3 |
| I-44 | L-4 |
| I-45 | L-6 |
| I-46 | L-9 |
| I-47 | L-10 |
| I-48 | L-11 |
| I-49 | L-14 |
| I-50 | L-15 |
| I-51 | L-16 |
| I-52 | L-18 |
| I-53 | L-19 |
| I-54 | L-21 |

The image forming performance and transferability of the resulting light-sensitive materials were evaluated in the same manner as in Example I-20. The color duplicated images obtained on coated paper were clear and free from background stain and had good image strength.

EXAMPLES I-55 TO I-65

A mixture of 3.5 g of X-form metal-free phthalocyanine, 10 g of Binder Resin (B-5) having the structure shown below, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.3 g of each of the resins (P) or resin grains (L) shown in Table I-4 below and the compounds for crosslinking shown in Table I-4 below, followed by further dispersing for 10 minutes. The glass beads were separated by filtration to prepare a dispersion for a light-sensitive layer.

Binder Resin (B-5)

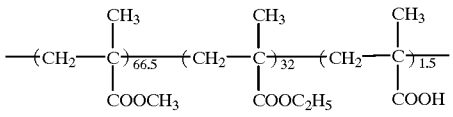

Mw $7\times10^4$

TABLE I-4

| Example | Resin (P) or Resin Grain (L) | Compound for Crosslinking | Amount |
|---|---|---|---|
| I-55 | P-19 | Phthalic anhydride | 0.2 g |
| | | Zirconium acetylacetone | 0.01 g |
| I-56 | P-22 | Gluconic acid | 0.008 g |
| I-57 | P-25 | N-Methylaminopropanol | 0.25 g |
| | | Dibutyltin dilaurate | 0.001 g |
| I-58 | P-9 | N,N'-Dimethylpropanediamine | 0.3 g |

TABLE I-4-continued

| Example | Resin (P) or Resin Grain (L) | Compound for Crosslinking | Amount |
|---|---|---|---|
| I-59 | P-7 | Propylene glycol | 0.2 g |
| | | Tetrakis(2-ethylhexane-diolato)titanium | 0.008 g |
| I-60 | L-18 | — | |
| I-61 | L-15 | N,N-Dimethylpropanediamine | 0.25 g |
| I-62 | P-13 | Divinyl adipate | 0.3 g |
| | | 2,2'-Azobis(isobutyronitrile) | 0.001 g |
| I-63 | P-6 | Propyltriethoxysilane | 0.01 g |
| I-64 | L-21 | N,N-Diethylbutanediamine | 0.3 g |
| I-65 | P-22 | Ethylene diglycidyl ether | 0.2 g |
| | | o-Chlorophenol | 0.001 g |

The resulting dispersion was coated on base paper for a paper master having a thickness of 0.2 mm, which had been subjected to electrically conductive treatment and solvent-resistant treatment, by a wire bar at a dry thickness of 8 $\mu$m, set to touch, dried in a circulating oven at 110° C. for 30 seconds and then heated at 140° C. for one hour.

The same procedure as in Example I-18 was conducted except for using the resulting light-sensitive element in place of the light-sensitive element employed in Example I-18 to prepare transferred images. The color images obtained on coated paper were clear and free from background stain and had good image strength.

EXAMPLE II-1

Figure 2:
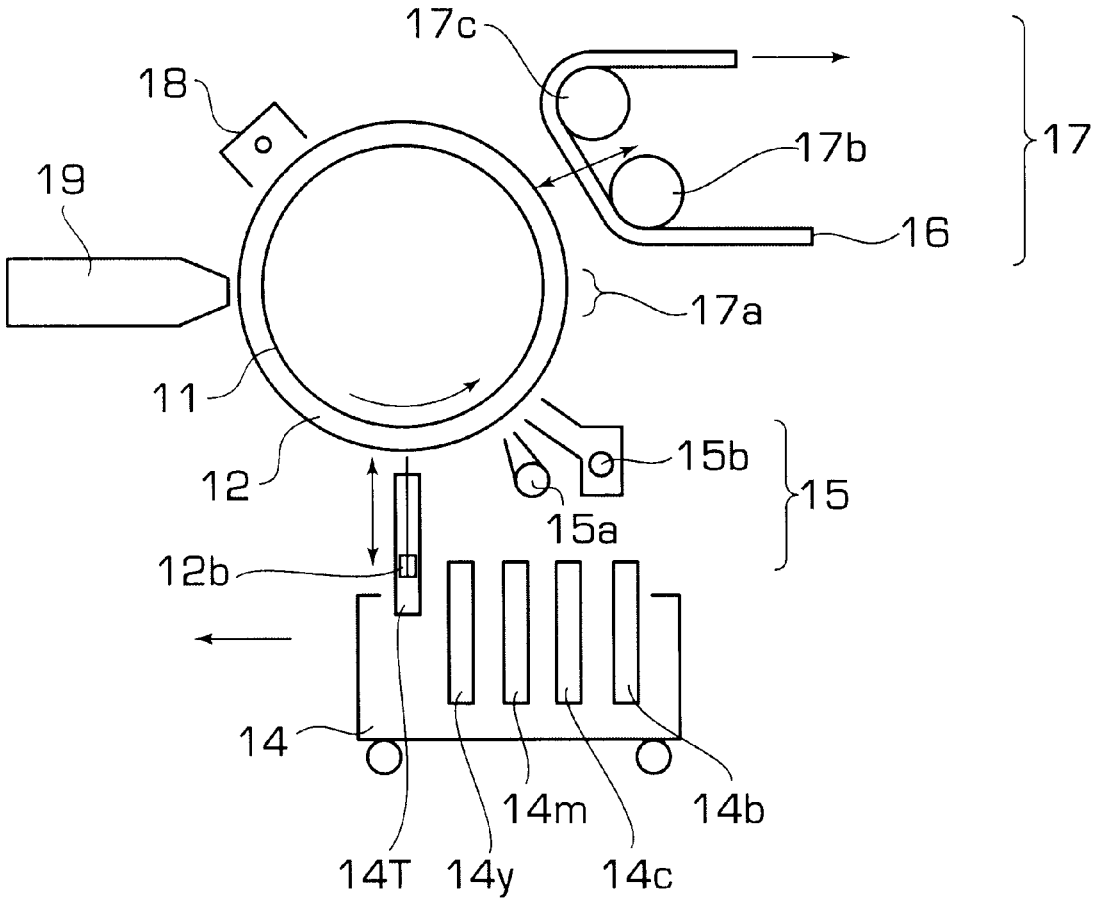
FIG. 2 is a schematic view of an apparatus for forming an electrophotographic transfer image using the electrodeposition coating method for the formation of transfer layer.

An amorphous silicon electrophotographic light-sensitive element was installed in an apparatus as shown in FIG. 2.

To one liter of Isopar H (manufactured by Esso Standard Oil Co.) were added 10 g (solid basis) of Thermoplastic Resin Grain (TL-1) and 0.001 g of zirconium naphthenate to prepare a dispersion of positively charged resin grains. On the surface of light-sensitive element installed on a drum which was rotated at a circumferential speed of 10 mm/sec, the dispersion of positively charged resin grains described above was supplied using a slit electrodeposition device, while putting the light-sensitive element to earth and applying an electric voltage of +200 V to an electrode of the slit electrodeposition device, whereby the resin grains were electrodeposited. The dispersive medium was removed by air-squeezing and the resin grains were fused by an infrared line heater to form a film, whereby a transfer layer composed of the thermoplastic resin was prepared on the light-sensitive element. A thickness of the transfer layer was 3 $\mu$m.

The resulting electrophotographic light-sensitive material (hereinafter, simply referred to as light-sensitive material sometimes) was immediately subjected to an electrophotographic process while maintaining its surface temperature to 40° C. Specifically, the light-sensitive material was charged to +700 V with a corona discharge in a dark place and exposed to light using a semiconductor laser having an oscillation wavelength of 780 nm on the basis of digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc. The potential in the exposed area was +220 V while it was +600 V in the unexposed area.

The exposed light-sensitive material was pre-bathed with Isopar H (manufactured by Esso Standard Oil Co.) by a pre-bathing means installed in a developing unit and then subjected to reversal development by supplying a liquid developer prepared by diluting a positively charged yellow toner for Signature System (manufactured by Eastman Kodak Co.) with 50-fold Isopar H from the developing unit to the surface of light-sensitive material while applying a bias voltage of +500 V to the developing unit side to thereby electrodeposite yellow toner particles on the unexposed areas. The light-sensitive material was then rinsed in a bath of Isopar H alone to remove stains in the non-image areas, followed by air-squeezing and dried by passing under a suction/exhaust unit and an infrared line heater.

The above procedure was repeated using each information for magenta, cyan and black in place of the information for yellow.

The light-sensitive material having yellow, magenta, cyan and black toner images on the transfer layer thereof was pre-heated by passing under an infrared line heater to maintain a surface temperature thereof measured by a radiation thermometer at about 80° C. and brought into contact with coated paper as a receiving material and they were passed between a pair of heating rubber rollers which were in contact with each other under a pressure of 10 kgf/cm$^2$ and whose surface temperature was constantly maintained at 120° C. at a transportation speed of 15 mm/sec.

After cooling the sheets while being in contact with each other by passing under a cooling roller, the coated paper was stripped from the light-sensitive element whereby the toner images on the light-sensitive material were wholly heat-transferred together with the transfer layer onto the coated paper. Further, the toner images were completely covered with the thermoplastic resin of transfer layer on the coated paper and thus they did not fall off when they were rubbed.

EXAMPLES II-2 TO II-11

Each dispersion for electrodeposition was prepared by adding 10 g (solid basis) of each of the thermoplastic resin grains (TL) shown in Table II-1 below, 10 g of branched hexadecyl alcohol (FOC-1600 manufactured by Nissan Chemical Industries, Ltd.) and 0.06 g of octadecyl vinyl ether/N-dodecyl maleic monoamide copolymer to one liter of Isopar G. The same procedure as in Example II-1 was conducted except for using each of the resulting dispersion in place of the dispersion containing Thermoplastic Resin Grain (TL-1) employed in Example II-1. Similar results to those in Example II-1 were obtained.

TABLE II-1

| Example | Thermoplastic Resin Grain (TL) |
|---|---|
| II-2 | TL-2 |
| II-3 | TL-3 |
| II-4 | TL-4 |
| II-5 | TL-5 |
| II-6 | TL-6 |
| II-7 | TL-7 |
| II-8 | TL-8 |
| II-9 | TL-9 |
| II-10 | TL-10 |
| II-11 | TL-11 |

EXAMPLE II-12

A mixture of 1 g of X-form metal-free phthalocyanine (manufactured by Dainippon Ink and Chemicals, Inc.), 10 g of Binder Resin (B-1) described above, 0.3 g of Resin (P-1), 0.15 g of Compound (A) described above, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 5 minutes to form a light-sensitive element comprising a light-sensitive layer having a thickness of 8 $\mu$m.

Using the resulting light-sensitive element in place of the light-sensitive element employed in Example II-1, the same procedure as in Example II-1 was conducted to prepare a transfer layer on the light-sensitive element.

The resulting light-sensitive material was charged to +450 V with a corona discharge in a dark place and exposed to light of a gallium-aluminum-arsenic semiconductor laser (output: 5 mW; oscillation wavelength: 780 nm) at an irradiation dose on the surface of the light-sensitive material of 30 erg/cm$^2$, a pitch of 25 $\mu$m, and a scanning speed of 300 cm/sec. The scanning exposure was in a negative mirror image mode based on digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc.

Thereafter, the exposed light-sensitive material was subjected to reversal development using a liquid developer prepared by diluting a yellow liquid developer for Signature System (manufactured by Eastman Kodak Co.) with 75-fold by weight Isopar H (manufactured by Esso Standard Oil Co.) in a developing machine having a pair of flat development electrodes while a bias voltage of +400 V was applied to the electrode on the side of the light-sensitive material to thereby electrodeposit toner particles on the exposed areas. The light-sensitive material was then rinsed in a bath of Isopar H alone to remove stains in the non-image areas.

The above procedure was repeated using each information for magenta, cyan and black in place of the information for yellow.

The light-sensitive material was then subjected to fixing by means of a heat roller whereby the toner images thus-formed were fixed.

The light-sensitive material having yellow, magenta, cyan and black toner images was brought into contact with coated paper as a receiving material and they were passed between a pair of rubber rollers which were in contact with each other under a pressure of 15 kgf/cm$^2$ and whose surface temperature was constantly maintained at 120° C. at a transportation speed of 10 mm/sec.

After cooling the sheets while being in contact with each other to room temperature, the coated paper was stripped from the light-sensitive element. The color images transferred on coated paper were visually evaluated for fog and image quality.

As a result it was found that the toner images on the light-sensitive material according to the present invention were wholly heat-transferred together with the transfer layer onto the coated paper. The transfer layer had an appropriate matting surface. The duplicated images obtained were clear and free from background stain, and degradation of image quality was not substantially observed when compared with the original. Further, since the toner images were completely covered with the thermoplastic resin of transfer layer on the coated paper, they did not fall off when they were rubbed and the strength of transferred images was sufficiently high.

EXAMPLE II-13

5 g of 4,4'-bis(diethylamino)-2,2'-dimethyltriphenylmethane as an organic photoconductive substance, 4 g of Binder Resin (B-2) described above, 0.8 g of Resin (P-3), 40 mg of Dye (D-2) described above, and 0.2 g of Anilide Compound (B) described above as a chemical sensitizer were dissolved in a mixed solvent of 30 ml of methylene chloride and 30 ml of ethylene chloride to prepare a solution for light-sensitive layer.

The resulting solution for light-sensitive layer was coated on a conductive transparent substrate composed of a 100 $\mu$m thick polyethylene terephthalate film having a deposited layer of indium oxide thereon (surface resistivity: $10^3$ Ω) by a wire round rod to prepare a light-sensitive element having an organic light-sensitive layer having a thickness of about 4 $\mu$m.

The procedure same as in Example II-12 was repeated except for using the resulting light-sensitive element in place of the light-sensitive element employed in Example II-12 to prepare transferred images. The color images obtained on coated paper were clear and free from background stain and had good image strength.

EXAMPLE II-14

A mixture of 3 g of X-form metal-free phthalocyanine (manufactured by Dainippon Ink and Chemicals, Inc.), 10 g of Binder Resin (B-3) described above, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 30 minutes to form a light-sensitive layer having a thickness of 8 $\mu$m.

In order to form an overcoat layer for imparting releasability on the surface of light-sensitive layer, a solution having the composition shown below was prepared.

| Overcoat Solution | |
|---|---|
| Methyl methacrylate/glycidyl methacrylate (80/20 by weight) copolymer (Mw: $6 \times 10^4$) | 3 g |
| Resin (P-2) | 0.15 g |
| Phthalic anhydride | 25 mg |
| o-Chlorophenol | 2 mg |
| Toluene | 100 g |

The solution was coated on the light-sensitive layer with a wire bar at a dry thickness of 2.0 $\mu$m, dried in an oven at 100° C. for 20 seconds and then heated at 140° C. for 1 hour. The coated film was allowed to stand in dark at 20° C. and 65% RH for 24 hours to prepare an electrophotographic light-sensitive element.

The procedure same as in Example II-12 was conducted except for using the resulting light-sensitive element in place of the light-sensitive element employed in Example II-12 to prepare transferred images. The color images obtained on coated paper were clear and free from background stain and had good image strength.

EXAMPLE II-15

A mixture of 100 g of photoconductive zinc oxide, 20 g of Binder Resin (B-4) described above, 4 g of Resin (P-30), 0.01 g of Dye (D-1) described above, 0.1 g of salicylic acid, and 150 g of toluene was disposed in a ball mill for 2 hours to prepare a dispersion for light-sensitive layer.

To the dispersion were added 0.1 g of phthalic anhydride and 0.02 g of zirconium acetylacetone, and the mixture was dispersed for 10 minutes.

The resulting dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer.

In order to confirm localization of the block copolymer according to the present invention in the surface portion of the light-sensitive layer, the adhesion strength was measured using an adhesive tape. As a result, it was found that the adhesion strength was reduced to one-fortieth that of a sample which did not contain Resin (P-30).

On the light-sensitive element, a transfer layer was formed in the same manner as in Example II-12.

The resulting light-sensitive material was charged to −600 V with a corona discharge in a dark place and exposed to light using a semiconductor laser having an oscillation wavelength of 780 nm at an irradiation dose of 25 erg/cm$^2$ on the surface of the light-sensitive material in a positive mirror image mode based on an information for yellow color separation of digital image data same as those described in Example II-1. The residual potential of the exposed areas was −120 V. Then, the exposed light-sensitive material was subjected to normal development using a liquid developer prepared by diluting a yellow toner for an electrostatic color plotter (Versateck 3000 manufactured by Xerox Corp.) with 50-fold Isopar H (manufactured by Esso Standard Oil Co.) in a developing machine having a pair of flat development electrodes while a bias voltage of −200 V was applied to the electrode on the side of the light-sensitive material to thereby electrodeposit toner particles on the unexposed areas. The light-sensitive material was then rinsed in a bath of Isopar H alone to remove stains in the non-image areas.

The above procedure was repeated using each information for magenta, cyan and black in place of the information for yellow.

The light-sensitive material having yellow, magenta, cyan and black toner images was brought into contact with coated paper as a receiving material and they were passed between a pair of rubber rollers which were in contact with each other under a pressure of 10 kgf/cm$^2$ and whose surface temperature was constantly maintained at 120° C. at a transportation speed of 6 mm/sec.

After cooling the sheets while being in contact with each other to room temperature, the coated paper was stripped from the light-sensitive element whereby the toner images on the light-sensitive material were wholly heat-transferred together with the transfer layer onto the coated paper. The transfer layer had an appropriate matting surface. The duplicated images obtained were glossy and degradation of image quality was not substantially observed when compared with the original. Further, the toner images were completely covered with the thermoplastic resin of transfer layer on the coated paper and thus they did not fall off when they were rubbed.

EXAMPLES II-16 TO II-35

Each electrophotographic light-sensitive material was prepared in the same manner as in Example II-12 except for using 0.2 g of each of the resins (P) shown in Table II-2 below in place of 0.3 g of Resin (P-1) employed in Example II-12.

TABLE II-2

| Example | Resin (P) |
|---|---|
| II-16 | P-3 |
| II-17 | P-4 |
| II-18 | P-6 |
| II-19 | P-10 |
| II-20 | P-11 |
| II-21 | P-12 |
| II-22 | P-13 |
| II-23 | P-15 |
| II-24 | P-16 |
| II-25 | P-17 |
| II-26 | P-18 |
| II-27 | P-20 |
| II-28 | P-24 |
| II-29 | P-26 |
| II-30 | P-28 |
| II-31 | P-29 |
| II-32 | P-33 |
| II-33 | P-35 |
| II-34 | P-36 |
| II-35 | P-38 |

The image forming performance and transferability of the resulting light-sensitive materials were evaluated in the same manner as in Example II-12. The color duplicated images obtained on coated paper were clear and free from background stain and had good image strength.

EXAMPLE II-36

An electrophotographic light-sensitive material was prepared in the same manner as in Example II-14 except for using 0.3 g (solid basis) of Resin Grain (L-1) in place of 0.15 g of Resin (P-2) employed in Example II-14. Using the resulting light-sensitive material, a color proof was prepared in the same manner as in Example II-14. The color duplicated image obtained was clear and free from background stain.

EXAMPLES II-37 TO II-48

Each electrophotographic light-sensitive material was prepared in the same manner as in Example II-36 except for using 0.3 g (solid basis) of each of the resin grains (L) shown in Table II-3 below in place of 0.3 g of Resin Grain (L-1) employed in Example II-36.

TABLE II-3

| Example | Resin Grain (L) |
|---|---|
| II-37 | L-3 |
| II-38 | L-4 |
| II-39 | L-6 |
| II-40 | L-9 |
| II-41 | L-10 |
| II-42 | L-11 |
| II-43 | L-14 |

TABLE II-3-continued

| Example | Resin Grain (L) |
|---|---|
| II-44 | L-15 |
| II-45 | L-16 |
| II-46 | L-18 |
| II-47 | L-19 |
| II-48 | L-21 |

The image forming performance and transferability of the resulting light-sensitive materials were evaluated in the same manner as in Example II-14. The color duplicated images obtained on coated paper were clear and free from background stain and had good image strength.

EXAMPLES II-49 TO II-59

A mixture of 3.5 g of X-form metal-free phthalocyanine, 10 g of Binder Resin (B-5) described above, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.3 g of each of the resins (P) or resin grains (L) shown in Table II-4 below and the compounds for crosslinking shown in Table II-4 below, followed by further dispersing for 10 minutes. The glass beads were separated by filtration to prepare a dispersion for a light-sensitive layer.

TABLE II-4

| Example | Resin (P) or Resin Grain (L) | Compound for Crosslinking | Amount |
|---|---|---|---|
| II-49 | P-19 | Phthalic anhydride | 0.2 g |
| | | Zirconium acetylacetone | 0.01 g |
| II-50 | P-22 | Gluconic acid | 0.008 g |
| II-51 | P-25 | N-Methylaminopropanol | 0.25 g |
| | | Dibutyltin dilaurate | 0.001 g |
| II-52 | P-9 | N,N'-Dimethylpropanediamine | 0.3 g |
| II-53 | P-7 | Propylene glycol | 0.2 g |
| | | Tetrakis(2-ethylhexane-diolato)titanium | 0.008 g |
| II-54 | L-18 | — | |
| II-55 | L-15 | N,N-Dimethylpropanediamine | 0.25 g |
| II-56 | P-13 | Divinyl adipate | 0.3 g |
| | | 2,2'-Azobis(isobutyronitrile) | 0.001 g |
| II-57 | P-6 | Propyltriethoxysilane | 0.01 g |
| II-58 | L-21 | N,N-Diethylbutanediamine | 0.3 g |
| II-59 | P-22 | Ethylene diglycidyl ether | 0.2 g |
| | | o-Chlorophenol | 0.001 g |

The resulting dispersion was coated on base paper for a paper master having a thickness of 0.2 mm, which had been subjected to electrically conductive treatment and solvent-resistant treatment, by a wire bar, at a dry thickness of 8 $\mu$m set to touch, dried in a circulating oven at 110° C. for 30 seconds and then heated at 140° C. for one hour.

The same procedure as in Example II-12 was conducted except for using the resulting light-sensitive element in place of the light-sensitive element employed in Example II-12 to prepare transferred images. The color images obtained on coated paper were clear and free from background stain and had good image strength.

EXAMPLE II-60

SYNTHESIS EXAMPLE 12 OF THERMOPLASTIC RESIN GRAIN (TL): (TL-12)

A mixture of 10 g of ethylene/vinyl acetate copolymer as a thermoplastic resin, 5 g of styrene/butadiene copolymer (Sorprene 1205 manufactured by Asahi Kasei K.K.) as a dispersion stabilizing resin and 85 g of Isopar G was put in a 500 ml-volume glass container together with glass beads and dispersed in a paint shaker for 5 hours. The glass beads were separated by filtration to prepare a dispersion of thermoplastic resin. An average grain diameter of the resulting resin grains was 0.55 μm.

A dispersion for electrodeposition was prepared by adding 12 g (solid basis) of Thermoplastic Resin Grain (TL-12) described above, 5 g of branched tetradecyl alcohol (FOC-1400 manufactured by Nissan Chemical Industries, Ltd.) and 0.02 g of octadecene/N-dodecyl maleic monoamide copolymer to Isopar G to make one liter.

The same procedure as in Example II-1 was conducted except for using the dispersion for electrodeposition described above in place of the dispersion containing Thermoplastic Resin Grain (TL-1) employed in Example II-1 to prepare a transfer layer.

The same procedure as in Example II-12 was conducted except for using the resulting light-sensitive element in place of the light-sensitive element employed in Example II-12 to prepare transferred images. The color images obtained on coated paper were clear and free from background stain and had good image strength.

EXAMPLES II-61 TO II-67

The same procedure as in Example II-60 was repeated except for using each of the resins shown in Table II-5 below in place of the ethylene/vinyl acetate copolymer employed as the thermoplastic resin in Example II-60 to prepare a transfer layer.

TABLE II-5

| Example | Dispersion of Thermoplastic Resin Grains | Thermoplastic Resin |
|---|---|---|
| II-61 | TL-13 | Cellulose Acetate Butyrate (Cellidor Bsp manufactured by Bayer AG) |
| II-62 | TL-14 | Polyvinyl Butyral Resin (S-Lec manufactured by Sekisui Chemical Co., Ltd.) |
| II-63 | TL-15 | Cellulose Propionate (Cellidoria manufactured by Daicel Co., Ltd.) |
| II-64 | TL-16 | Polydecamethylene Terephthalate |
| II-65 | TL-17 | Polydecamethylene Isophthalate |
| II-66 | TL-18 | Poly-4-methylpentene-1 |
| II-67 | TL-19 | Polypentamethylene Carbonate |

The same procedure as in Example II-12 was conducted except for using the resulting light-sensitive element in place of the light-sensitive element employed in Example II-12 to prepare transferred images. The color images obtained on coated paper were clear and free from background stain and had good image strength.

EXAMPLE II-68

Figure 3:
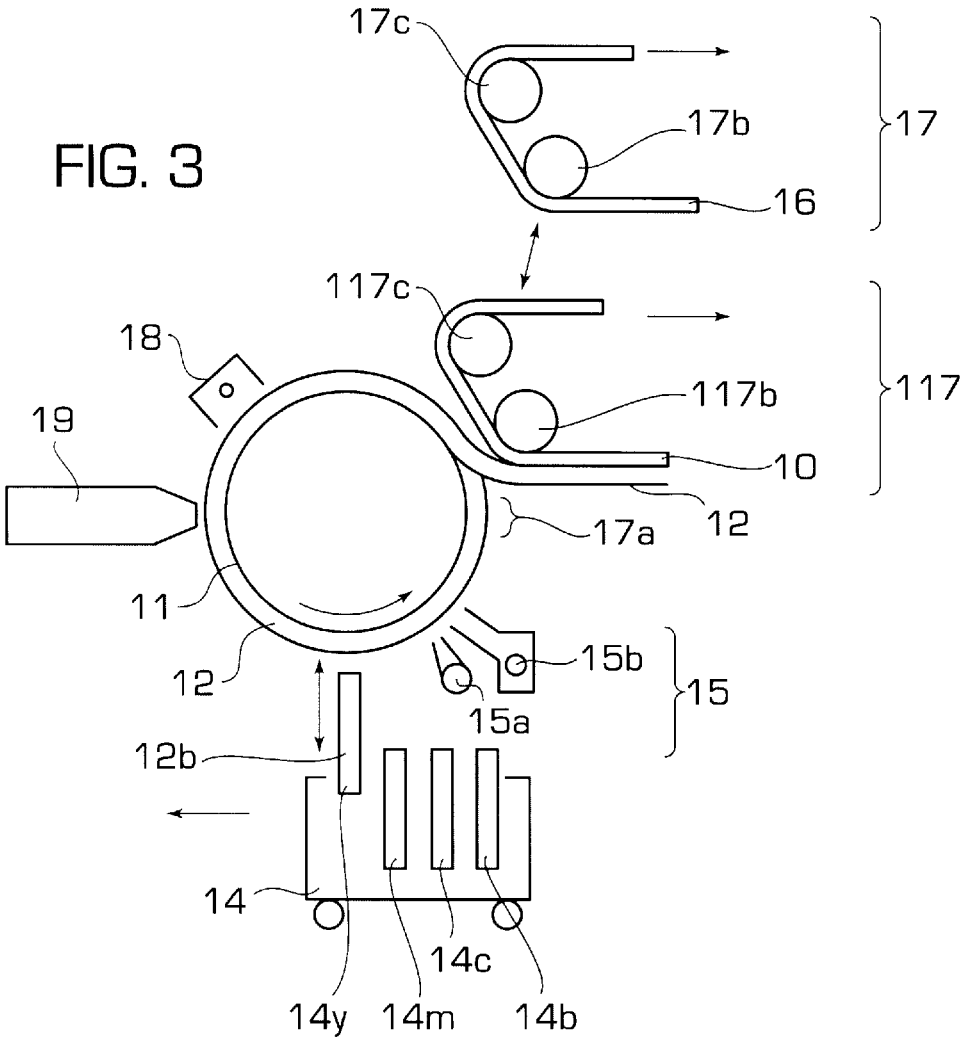
FIG. 3 is a schematic view of an apparatus for forming an electrophotographic transfer image using the transfer method for the formation of transfer layer.
Figure 4:
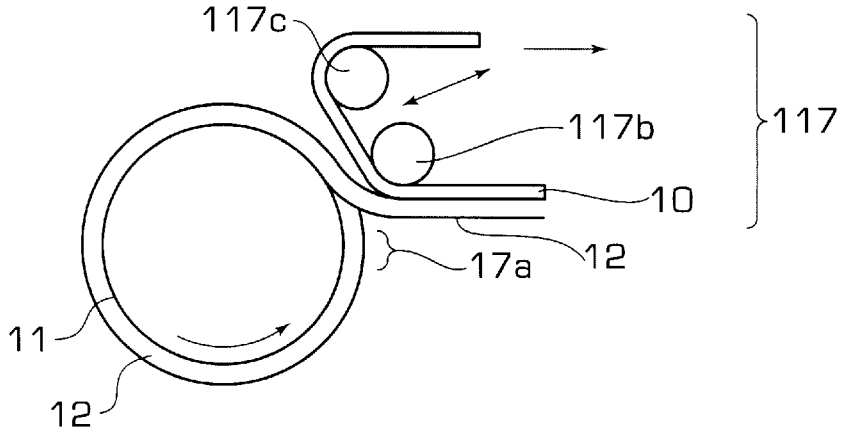
FIG. 4 is a schematic view of a device for the formation of transfer layer utilizing release paper.

The light-sensitive element comprising X-form metal-free phthalocyanine and having the surface releasability which had been prepared in Example II-12 was installed in a device as shown in FIG. 3.

On release paper (Sanrelease manufactured by Sanyo-Kokusaku Pulp Co., Ltd.) was provided a transfer layer comprising polyvinyl acetate and having a thickness of 3 μm. The resulting paper was installed in a heat transfer means 117 of the device in FIG. 3 and the transfer layer was peeled from the release paper and transferred onto the surface of light-sensitive element under conditions of a nip pressure of the rollers of 3 kgf/cm$^2$, a surface temperature of 80° C. and a transportation speed of 10 mm/sec.

The formation of toner image by an electrophotographic process on the resulting transfer layer and transfer of the toner image together with the transfer layer were performed in the same manner as in Example II-12 to form color images on coated paper.

The color images obtained were clear and free from background stain, and degradation of image quality was not substantially observed when compared with the original.

These results illustrate that in a case wherein a transfer layer is formed on the surface of light-sensitive element using release paper and transferred onto coated paper after the formation of toner image thereon, the transfer layer is uniformly and completely transferred at each transfer step without any adverse effect on image quality.

POSSIBILITY OF UTILIZATION IN INDUSTRY

In accordance with the present invention, a transfer layer containing a thermoplastic resin is formed on the surface of light-sensitive element in an apparatus for transfer and, after conducting wet type toner development, transferred together with toner images onto a receiving material. Therefore, color images of high accuracy and high quality can be simply and stably obtained at a low cost.

What is claimed is:

1. A method of forming an electrophotographic transfer image comprising the steps of:

(a) forming a peelable transfer layer consisting essentially of a thermoplastic resin on a surface of an electrophotographic light-sensitive element by an electrodeposition coating method, wherein the electrophotographic light-sensitive element comprises a polymer comprising:

(i) a polymer component having at least one atom selected from the group consisting of a silicon atom and a fluorine atom, and (ii) a polymer component comprising a cross-linking structure having as a partial structure thereof a group selected from the group consisting of a photo-curable group, a heat-curable group, and a photo- and heat-curable group, wherein said polymer is at or near the surface of the electrophotographic light-sensitive element, and wherein said polymer provides the surface of the electrophotographic light-sensitive element with releasability, (b) forming a toner image by an electrophotographic process on the transfer layer, (c) heat-transferring the toner image together with the transfer layer onto a receiving material, and (d) repeating steps (a), (b), and (c) using the electrophotographic element resulting from step (c);

wherein the electrodeposition coating method comprises supplying a dispersion of grains consisting essentially of the thermoplastic resin having a glass transition point of from 20° C. to 90° C. or a softening point of from 40° C. to 150° C. in an electrical insulating solvent having an electric resistance of not less than $10^8$ Ω·cm and a dielectric constant of not more that 3.5 between the electrophotographic light-sensitive element and an electrode placed face-to-face with the light-sensitive element, said grains migrating due to electrophoresis according to potential gradient applied from an external power source to adhere to or electrodeposit on the electrophotographic light-sensitive element, and transforming the adhered or electrodeposited grains into a uniform film to produce said peelable transfer layer.

2. A method of forming an electrophotographic transfer image as claimed in claim 1, wherein the polymer is a block copolymer comprising at least one polymer segment (A) containing not less than 50% by weight of a fluorine atom and/or silicon atom-containing polymer component and at least one polymer segment (B) containing 0 to 20% by weight of a fluorine atom and/or silicon atom-containing polymer component, the polymer segments (A) and (B) being bonded in the form of blocks.

3. A method of forming an electrophotographic transfer image as claimed in claim 1, wherein the polymer is a random copolymer having a fluorine atom and/or silicon atom-containing polymer component content of not less than 60% by weight based upon the total polymer components.

4. The method according to claim 1, wherein the steps (a), (b) and (c) are performed in one apparatus.

5. An apparatus for forming an electrophotographic transfer image comprising:

(a) an electrophotographic light-sensitive element a surface of which has releasability, (b) a means for forming a peelable transfer layer consisting essentially of a thermoplastic resin on the surface of the electrophotographic light-sensitive element by an electrodeposition coating method, (c) a means for forming a toner image by an electrophotographic process on the transfer layer, and (d) a means for repeatedly heat-transferring the toner image together with the transfer layer onto a receiving material, wherein said electrophotographic light-sensitive element (a) comprises a polymer comprising (i) a polymer component having at least one atom selected from the group consisting of a silicon atom and a fluorine atom and (ii) a polymer component comprising a cross-linking structure having as a partial structure thereof a group selected from the group consisting of a photo-curable group, a heat-curable group, and a photo- and heat-curable group;

and wherein the means for forming a peelable transfer layer by an electrodeposition coating method comprises a means for supplying a dispersion of grains consisting essentially of the thermoplastic resin having a glass transition point of from 20° C. to 90° C. or a softening point of from 40° C. to 150° C. in an electrical insulating solvent having an electric resistance of not less than $10^8$ Ω·cm and a dielectric constant of not more than 3.5 between the electrophotographic light-sensitive element and an electrode placed face-to-face with the light-sensitive element, said grains migrating due to electrophoresis according to potential gradient applied from an external power source to adhere to or electrodeposit on the electrophotographic light-sensitive element, and for transforming the adhered or electrodeposited grains into a uniform film to produce said peelable transfer layer.

* * * * *